US010557288B2

(12) United States Patent
Ramakrishna et al.

(10) Patent No.: US 10,557,288 B2
(45) Date of Patent: Feb. 11, 2020

(54) HOOP LOCK WITH BENT FOOT ENGAGEMENT

(71) Applicant: Schlage Lock Company LLC, Indianapolis, IN (US)

(72) Inventors: Manjunatha Ramakrishna, Bangalore (IN); Subashchandra G. Rai, Bangalore (IN); Vijayakumar Mani, Bangalore (IN); Tejas V Kumar, Channasandra (IN); Hassan Charan Kumar, Bangalore (IN)

(73) Assignee: Schlage Lock Company LLC, Carmel, IN (US)

( * ) Notice: Subject to any disclaimer, the term of this patent is extended or adjusted under 35 U.S.C. 154(b) by 0 days.

(21) Appl. No.: 14/689,829

(22) Filed: Apr. 17, 2015

(65) Prior Publication Data

US 2016/0305163 A1 Oct. 20, 2016

(51) Int. Cl.

| | |
|---|---|
| ***E05B 67/22*** | (2006.01) |
| ***E05B 67/08*** | (2006.01) |
| ***E05B 67/06*** | (2006.01) |
| *E05B 67/00* | (2006.01) |
| *E05B 67/02* | (2006.01) |
| *E05B 67/10* | (2006.01) |
| *E05B 67/24* | (2006.01) |

(52) U.S. Cl.

CPC ..... *E05B 67/08* (2013.01); *E05B 67/063* (2013.01); *E05B 67/003* (2013.01); *E05B 67/02* (2013.01); *E05B 67/06* (2013.01); *E05B 67/10* (2013.01); *E05B 67/24* (2013.01)

(58) Field of Classification Search

CPC ..... E05B 67/24; E05B 67/003; E05B 67/22; E05B 67/063; E05B 67/06; E05B 67/02; E05B 67/10; E05B 67/18; E05B 67/36; E05B 67/08

USPC ..... 70/39, 38 A, 28, 53, 40, 41

See application file for complete search history.

(56) References Cited

U.S. PATENT DOCUMENTS

| | | | | |
|---|---|---|---|---|
| 206,327 A * | 7/1878 | Hillebrand | ..... | E05B 67/24 70/38 A |
| 2,011,515 A * | 8/1935 | Fraim | ..... | E05B 67/24 70/38 C |
| 3,626,729 A * | 12/1971 | Fane | ..... | E05B 67/24 70/18 |
| 3,882,699 A * | 5/1975 | Flack | ..... | E05B 67/38 70/368 |
| 4,064,716 A * | 12/1977 | Shwayder | ..... | E05B 67/22 70/38 A |

(Continued)

FOREIGN PATENT DOCUMENTS

WO 1994010414 A1 5/1994

*Primary Examiner* — Peter M. Cuomo
*Assistant Examiner* — Morgan J McClure
(74) *Attorney, Agent, or Firm* — Taft Stettinius & Hollister LLP

(57) ABSTRACT

A hoop lock assembly including a shackle and a crossbar. The shackle includes a straight foot and an angled foot. The crossbar is operable to receive the straight foot and the angled foot, and includes a primary locking mechanism and a secondary locking mechanism. The primary locking mechanism is operable to selectively prevent removal of the straight foot from the crossbar. The secondary locking mechanism is operable to selectively prevent removal of the angled foot from the crossbar.

14 Claims, 28 Drawing Sheets

(56) References Cited

U.S. PATENT DOCUMENTS 4,112,715 A * 9/1978 Uyeda ..... E05B 67/24 70/38 A
4,241,594 A * 12/1980 Miller ..... E05B 67/24 70/369
4,345,447 A * 8/1982 Keung ..... E05B 67/24 292/37
4,584,855 A * 4/1986 Burlingame ..... E05B 17/14 70/38 A
4,841,753 A * 6/1989 Patton ..... E05B 67/22 70/38 A
4,918,949 A * 4/1990 Newbold ..... E05B 67/063 70/38 A
4,920,772 A * 5/1990 Denison ..... E05B 67/063 70/233
5,010,746 A * 4/1991 Zane ..... E05B 67/063 70/233
5,092,142 A * 3/1992 Zane ..... E05B 67/063 70/233
5,186,029 A * 2/1993 Myers ..... E05B 67/24 70/371
5,195,340 A * 3/1993 Huang ..... B60R 25/0221 70/238
5,199,282 A * 4/1993 Wang ..... E05B 67/063 70/38 A
5,253,496 A 10/1993 Wang
5,331,830 A 7/1994 Su
5,406,812 A * 4/1995 Jaw ..... E05B 67/063 70/233
5,438,854 A * 8/1995 Seraj ..... E05B 67/06 70/233
5,488,845 A * 2/1996 Hsieh ..... E05B 67/24 70/233
5,490,402 A * 2/1996 Shieh ..... E05B 67/00 70/39
5,694,796 A 12/1997 Couillard et al.
5,706,679 A * 1/1998 Zane ..... E05B 67/003 70/18
5,832,753 A * 11/1998 Nielsen ..... B62H 5/00 224/425
5,832,762 A * 11/1998 McDaid ..... E05B 17/002 70/38 A
5,850,751 A * 12/1998 Kuo ..... E05B 37/025 70/26
6,026,663 A 2/2000 Tsung Chuan et al.
6,101,852 A * 8/2000 Steinbach ..... E05B 67/06 70/38 A
6,718,802 B2 * 4/2004 Vito ..... B62H 5/00 70/18
6,880,371 B2 4/2005 Huang
7,013,686 B1 * 3/2006 Chen ..... E05B 67/063 70/233
8,640,513 B2 * 2/2014 Goren ..... E05B 47/0603 340/5.2
2002/0053226 A1 * 5/2002 McDaid ..... E05B 9/084 70/38 A
2006/0266085 A1 * 11/2006 Reeves ..... B62H 5/145 70/39
2009/0282876 A1 * 11/2009 Zuraski ..... E05B 67/003 70/35
2012/0318028 A1 * 12/2012 Hahn ..... E05B 67/063 70/41
2015/0211261 A1 * 7/2015 Lasaroff ..... E05B 67/02 70/35
2015/0361692 A1 * 12/2015 Kindstrand ..... E05B 67/063 70/53

* cited by examiner

HOOP LOCK WITH BENT FOOT ENGAGEMENT

TECHNICAL FIELD

The present disclosure generally relates to hoop locks having removable shackles, and more particularly to hoop locks in which the shackle has a straight foot and an angled foot.

BACKGROUND

Hoop locks sometimes include a shackle including a pair of feet, a crossbar operable to receive the feet, and a locking mechanism which selectively prevents removal of one of the feet from the crossbar. In some hoop locks, one of the feet is angled, and the locking mechanism engages the straight foot. When the locking mechanism is unlocked, the shackle can be pivoted about the bent foot to remove the straight foot from the crossbar. Some such systems have certain limitations such as, for example, those relating to resistance to tampering or attack. Therefore, a need remains for further improvements in this technological field.

SUMMARY

An exemplary hoop lock assembly includes a shackle and a crossbar. The shackle includes a straight foot and an angled foot. The crossbar is operable to receive the straight foot and the angled foot, and includes a primary locking mechanism and a secondary locking mechanism. The primary locking mechanism is operable to selectively prevent removal of the straight foot from the crossbar. The secondary locking mechanism is operable to selectively prevent removal of the angled foot from the crossbar. Further embodiments, forms, features, and aspects of the present application shall become apparent from the description and figures provided herewith.

DETAILED DESCRIPTION OF ILLUSTRATIVE EMBODIMENTS

Figure 1:
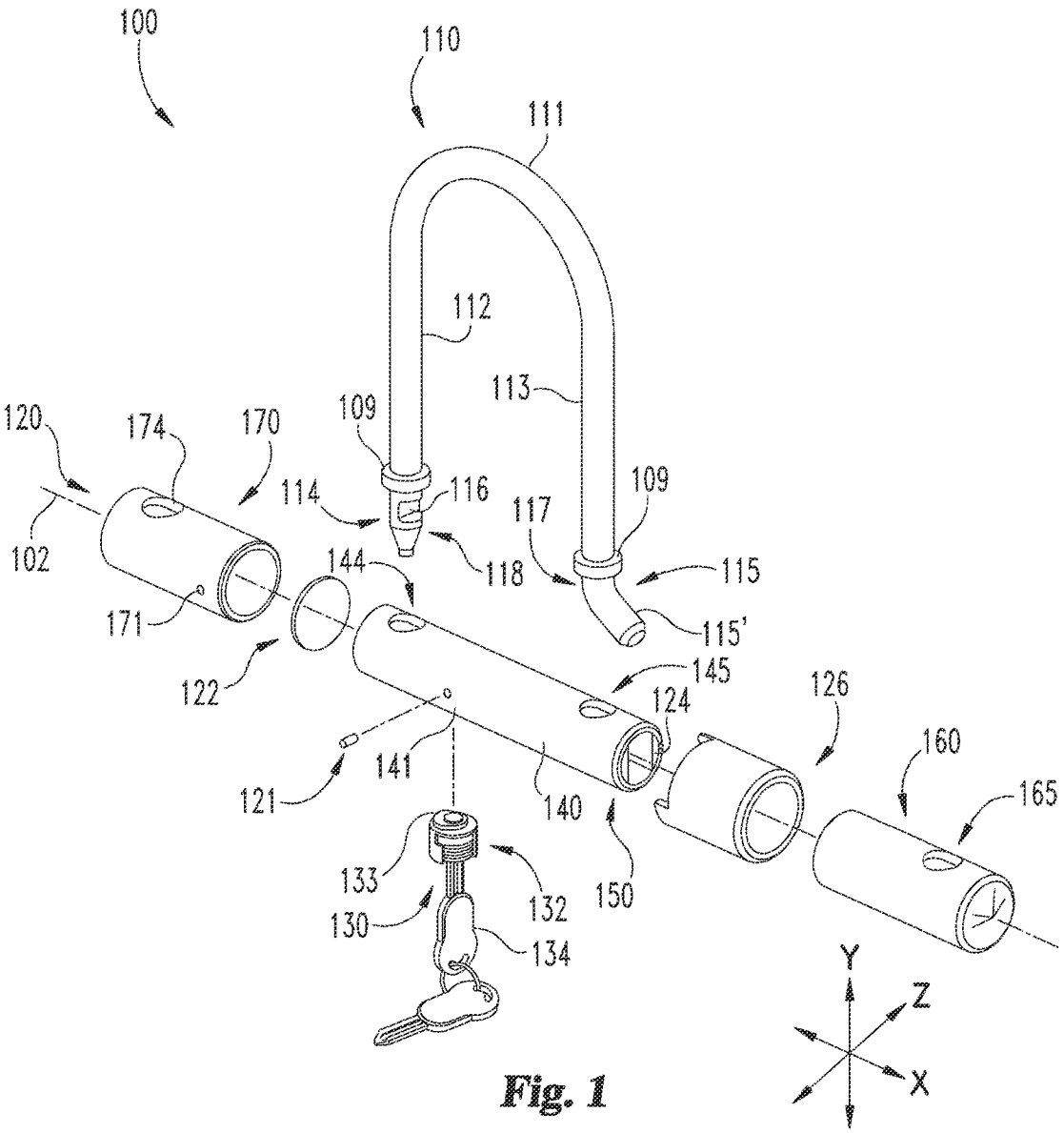
FIG. 1 is an exploded assembly illustration of a lock assembly according to one embodiment.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

As used herein, the terms "longitudinal", "lateral", and "transverse" are used to denote motion or spacing along three mutually perpendicular axes. In the coordinate plane illustrated in FIG. 1, the X-axis defines the longitudinal directions (including a proximal direction and a distal direction), the Y-axis defines the lateral directions, and the Z-axis defines the transverse directions. These terms are used for ease of convenience and description, and are without regard to the orientation of the system with respect to the environment. Additionally, motion or spacing along one direction need not preclude motion or spacing along another of the directions. For example, elements which are described as being "laterally offset" from one another may also be offset in the longitudinal and/or transverse directions, or may be aligned in the longitudinal and/or transverse directions. Furthermore, the X, Y and Z axes are illustrated to depict the general orientations of the longitudinal, lateral and transverse directions, and are not necessarily illustrated in the positions of the corresponding axes of the lock. For example, FIG. 1 includes both the longitudinal axis 102 of the lock 100, and with the X-axis illustrating the longitudinal directions. The terms are therefore not to be construed as limiting the scope of the subject matter described herein.

Figure 2:
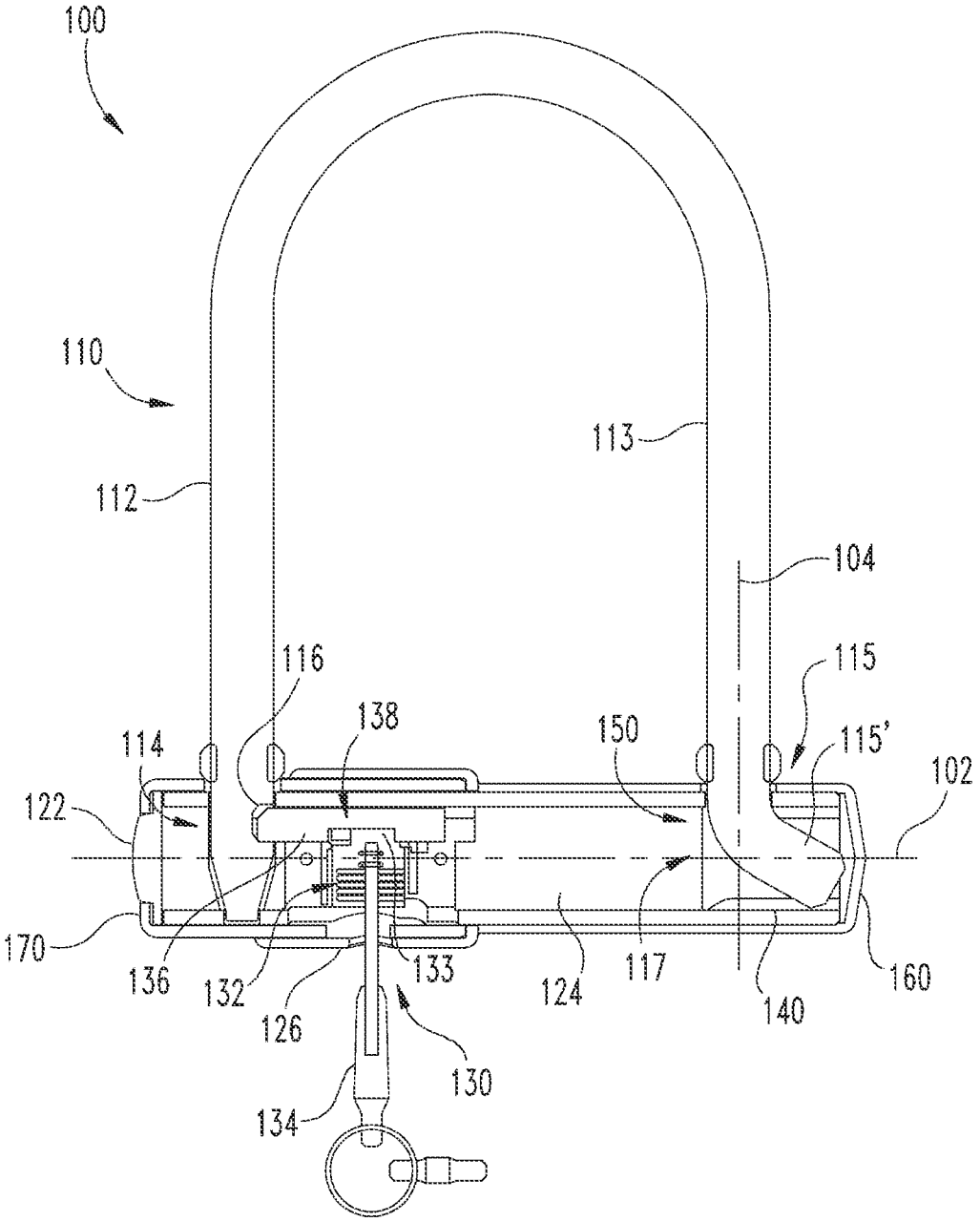
FIG. 2 is a side sectional view, partially in section, of the lock assembly illustrated in FIG. 1.
Figure 3:
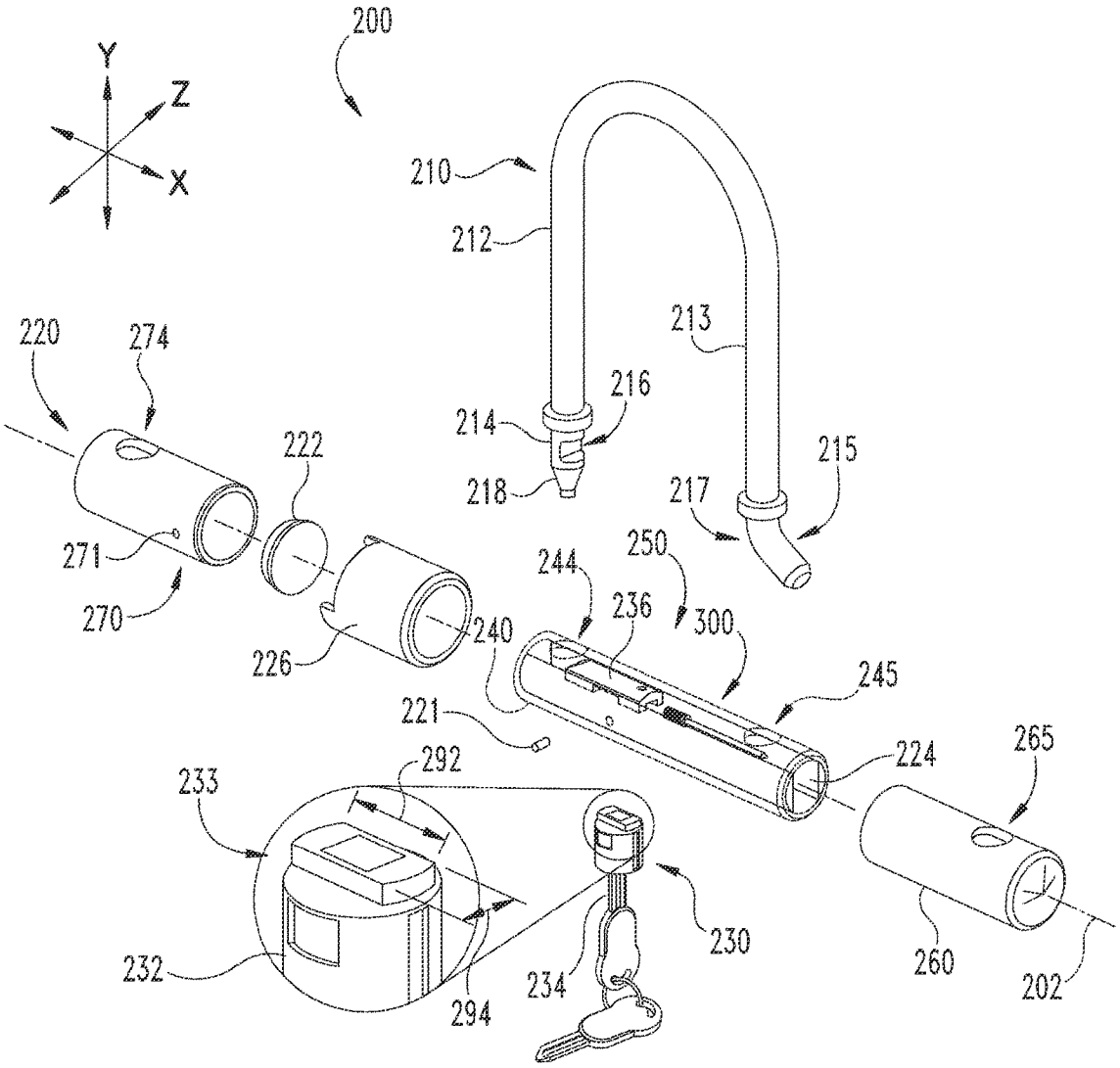
FIG. 3 is an exploded assembly illustration of a lock assembly according to another embodiment.

With reference to FIGS. 1 and 2, an exemplary lock assembly 100 according to one embodiment comprises a hoop or shackle 110, a crossbar 120, a primary locking mechanism 130 housed in the crossbar 120, and a secondary locking mechanism 150. As described in further detail below, the shackle 110 and crossbar 120 are separable, and the locking mechanisms 130, 150 are operable to selectively couple the shackle 110 to the crossbar 120. As illustrated in FIG. 2, with the shackle 110 coupled to the crossbar 120, the crossbar 120 extends along a longitudinal or X-axis 102, and the shackle 110 extends from the crossbar in the direction of a lateral or Y-axis 104, such that the axes 102, 104 define an X-Y plane of the lock assembly 100.

The shackle 110 includes an arcuate connecting portion 111 connecting a proximal first leg 112 and a distal second leg 113. In the illustrated form, the legs 112, 113 are arranged substantially parallel to one another and to the lateral axis 104 such that the shackle 110 is substantially U-shaped. It is also contemplated that shackle 110 may comprise other shapes such as, for example, the connecting portion 111 comprising a substantially rectilinear shape. The term "substantially" as used herein may be applied to modify a quantitative representation which could permissibly vary without resulting in a change in the basic function to which it relates. For example, the substantially parallel legs 112, 113 described above may permissibly be slightly askew or obliquely arranged relative to one another if the locking capability of the lock assembly 100 is not materially altered.

The proximal leg 112 includes a proximal foot 114, and the distal leg 113 includes a distal foot 115. With the shackle 110 engaged with the crossbar 120, the feet 114, 115 are received in openings or passages in the crossbar 120. The shackle 110 may also include bumpers 109 positioned adjacent the feet 114, 115 to provide a cushioning effect as the feet 114, 115 are inserted into the crossbar 120. The proximal foot 114 is arranged substantially parallel to the lateral axis 104, and the distal foot 115 includes an angled portion 115' which is angularly offset relative to the lateral axis 104 and extends in the distal direction. As such, the proximal foot 114 may be considered a straight foot, and the distal foot 115 may be considered an angled foot or a bent foot. The proximal foot 114 includes a transverse groove 116 operable to engage with the primary locking mechanism, and may also include a tapered toe 118. The distal foot 115 includes an engagement feature 117 operable to engage the secondary locking mechanism 150. The engagement feature 117 may include, for example, one or more grooves, recesses or openings sized and shaped to receive or engage a portion of the secondary locking mechanism 150.

The shackle 110 is operable in a plurality of positions with respect to the crossbar 120, including a removed position, a pivoted position, and a home position. In the removed position, neither the proximal foot 114 nor the distal foot 115 is received in the crossbar 120. When the distal foot 115 is inserted into the crossbar 120, the shackle 110 is in the pivoted position. In the pivoted position, the distal foot 115 is received in the crossbar 120, and the proximal foot 114 is not received in the crossbar 120. When in the pivoted position, the shackle 110 can be pivoted along the X-Y plane of the lock assembly 100 to the home position in which both the proximal foot 114 and the distal foot 115 are received in the crossbar 120. Additionally, the lock assembly 100 is operable in a plurality of states, including at least a decoupled state including the removed position, a transitional state including the pivoted position, and a coupled state including the home position.

The crossbar 120 includes a hollow tube 140 extending along the longitudinal axis 102, a tube cover 160 mounted on a distal side of the tube 140, a sleeve 170 mounted on a proximal side of the tube 140, and a housing 124 seated in the tube 140. The tube 140 includes a proximal opening 144 sized and shaped to receive the proximal foot 114, and a distal opening 145 sized and shaped to receive the distal foot 115. The tube cover 160 also includes an opening 165 which is generally aligned with the distal opening 145 when the tube cover 160 is mounted on the tube 140. Similarly, the sleeve 170 includes an opening 174 which is generally aligned with the proximal opening 144 when the sleeve 170 is mounted on the tube 140.

The sleeve 170 may be rotationally and axially coupled to the tube 140 such as, for example, by a pin 121 which extends into an opening 141 in the tube 140 and through an opening 171 in the sleeve 170. The sleeve 170 may retain an end cap 122 in engagement with the proximal end of the tube 140 to retain internal components of the crossbar 120 within the tube 140. The crossbar 120 may also include a dust cover 126 rotatably mounted on the tube 140 and operable to selectively cover a keyhole through which a key can be inserted to operate the primary locking mechanism 130.

The primary locking mechanism 130 generally includes a lock cylinder 132 having a cam 133 which is rotatable between a locking position and an unlocking position upon insertion of a proper key 134 into the lock cylinder 132. The primary locking mechanism 130 also includes a movable deadbolt 136 including a recess 138 into which the cam 133 is received. The deadbolt 136 is engaged with the cam 133 and is selectively engageable with the proximal foot 114. More specifically, the deadbolt 136 has an extended position and a retracted position. With the shackle 110 in the home position, the deadbolt 136 extends into the groove 116 when in the extended position, and does not extend into the groove 116 when in the retracted position.

Additionally, the primary locking mechanism 130 has a primary locking state in which the primary locking mechanism 130 is operable to prevent removal of the proximal foot 114 from the crossbar 120, and a primary unlocking state in which the primary locking mechanism 130 is not operable to prevent removal of the proximal foot 114 from the crossbar 120. The locking/unlocking state of the primary locking mechanism 130 is defined by the locking/unlocking position of the cam 133. With the cam 133 in the locking position, the deadbolt 136 is retained in the extended position. As a result, the primary locking mechanism 130 is engaged with the proximal foot 114 and retains the proximal foot 114 within the crossbar 120. In the primary unlocking state, the deadbolt 136 is disengaged or disengageable from the proximal foot 114. As a result, the shackle 110 can be pivoted along the X-Y plane from the home position to the pivoted position to remove the proximal foot 114 from the proximal opening 144.

In the illustrated form, the cam 133 is configured to move the deadbolt 136 between the extended and refracted positions when rotated by the key 134. When in the locking position, the cam 133 retains the deadbolt 136 in the extended position. When in the unlocking position, the cam 133 retains the deadbolt 136 in the retracted position. As such, the primary locking state includes the extended deadbolt position, and the primary unlocking state includes the retracted deadbolt position. In other embodiments, the deadbolt 136 may be retained in the extended position when the cam 133 is in the locking position, and may be movable to the retracted position when the cam 133 is in the unlocking position. An exemplary form of such an embodiment is described below with reference to FIGS. 3-6.

As should be evident from the foregoing, the primary locking mechanism 130 is operable to selectively couple the shackle 110 to the crossbar 120 by engaging the straight proximal foot 114. As noted above, the lock assembly 100 also includes a secondary locking mechanism 150. The secondary locking mechanism 150 is operable to selectively couple the shackle 110 to the crossbar 120 by engaging the angled distal foot 115. Exemplary forms of such secondary locking mechanisms are described in further detail below.

With reference to FIGS. 3-33, illustrated therein are lock assemblies according to other embodiments. Each of the lock assemblies is substantially similar to the lock assembly 100. Unless indicated otherwise, similar reference characters are used to indicate similar elements and features. In the interest of conciseness, the following descriptions focus primarily on elements and features that are different than those described above with regard to the lock assembly 100. Additionally, while the embodiments illustrated hereinafter are substantially similar to the lock assembly 100, it is also contemplated that the secondary locking mechanisms described hereinafter may be utilized in combination with other forms of a hoop lock.

With specific reference to FIGS. 3-6, a lock assembly 200 according to another embodiment generally includes a shackle 210 including a straight proximal foot 214 and an angled distal foot 215, and a crossbar 220 including a primary locking mechanism 230 operable to engage the proximal foot 214 and a secondary locking mechanism 250 operable to engage the distal foot 215. The primary locking mechanism 230 has a primary locking state in which the primary locking mechanism 230 is operable to retain the proximal foot 214 within the crossbar 220, and a primary unlocking state in which the primary locking mechanism 230 is not operable to prevent removal of the proximal foot 214 from the crossbar 220. Similarly, the secondary locking mechanism 250 has a secondary locking state in which the secondary locking mechanism 250 is operable to retain the distal foot 215 within the crossbar 220, and a secondary unlocking state in which the secondary locking mechanism 250 is not operable to prevent removal of the distal foot 215 from the crossbar 220.

The shackle 210 is operable in a plurality of operational positions with respect to the crossbar 220, including the above-described removed, pivoted, and home positions. Additionally, the lock assembly 200 is operable in a plurality of states, including at least a decoupled state including the removed shackle position, a transitional state including the pivoted shackle position, and a coupled state including the home shackle position.

As described in further detail below, the locked/unlocked state of each of the locking mechanisms 230, 250 is controlled by the lock cylinder 232 and the cam 233. The illustrative cam 233 is oblong and has a larger length dimension 292 and a smaller width dimension 294. When the proper key 234 is inserted in the lock cylinder 232, the cam 233 is rotatable between an unlocking position (FIG. 5) in which the width dimension 294 is arranged substantially parallel to the longitudinal axis 202, and a locking position (FIG. 6) in which the length dimension 292 is arranged substantially parallel to the longitudinal axis 202.

Figure 4:
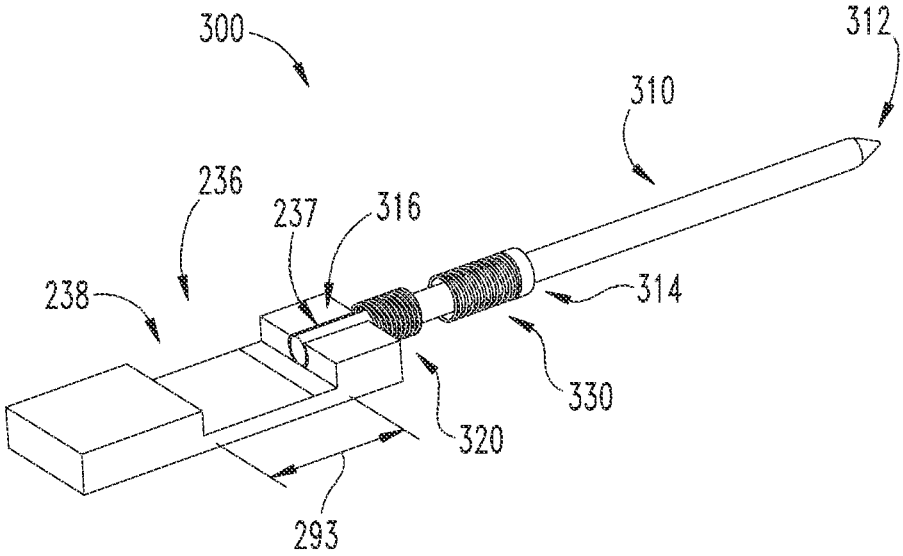
FIG. 4 is a perspective illustration of a portion of the lock assembly illustrated in FIG. 3.

The secondary locking mechanism 250 includes a plunger assembly 300. As illustrated in FIG. 4, the plunger assembly 300 includes a plunger 310, a deadbolt spring 320, and a plunger spring 330. The plunger 310 includes a distal end 312, a shoulder 314, and a proximal end 316. The plunger 310 is longitudinally movable between an extended plunger position and a retracted plunger position. The deadbolt 236 includes a channel 237, and the proximal end 316 of the plunger 310 is slidingly received in the channel 237. The channel 237 extends from a distal end of the deadbolt 236 to a recess 238 which has a length dimension 293 corresponding to the length dimension 292 of the cam 233.

Figure 5:
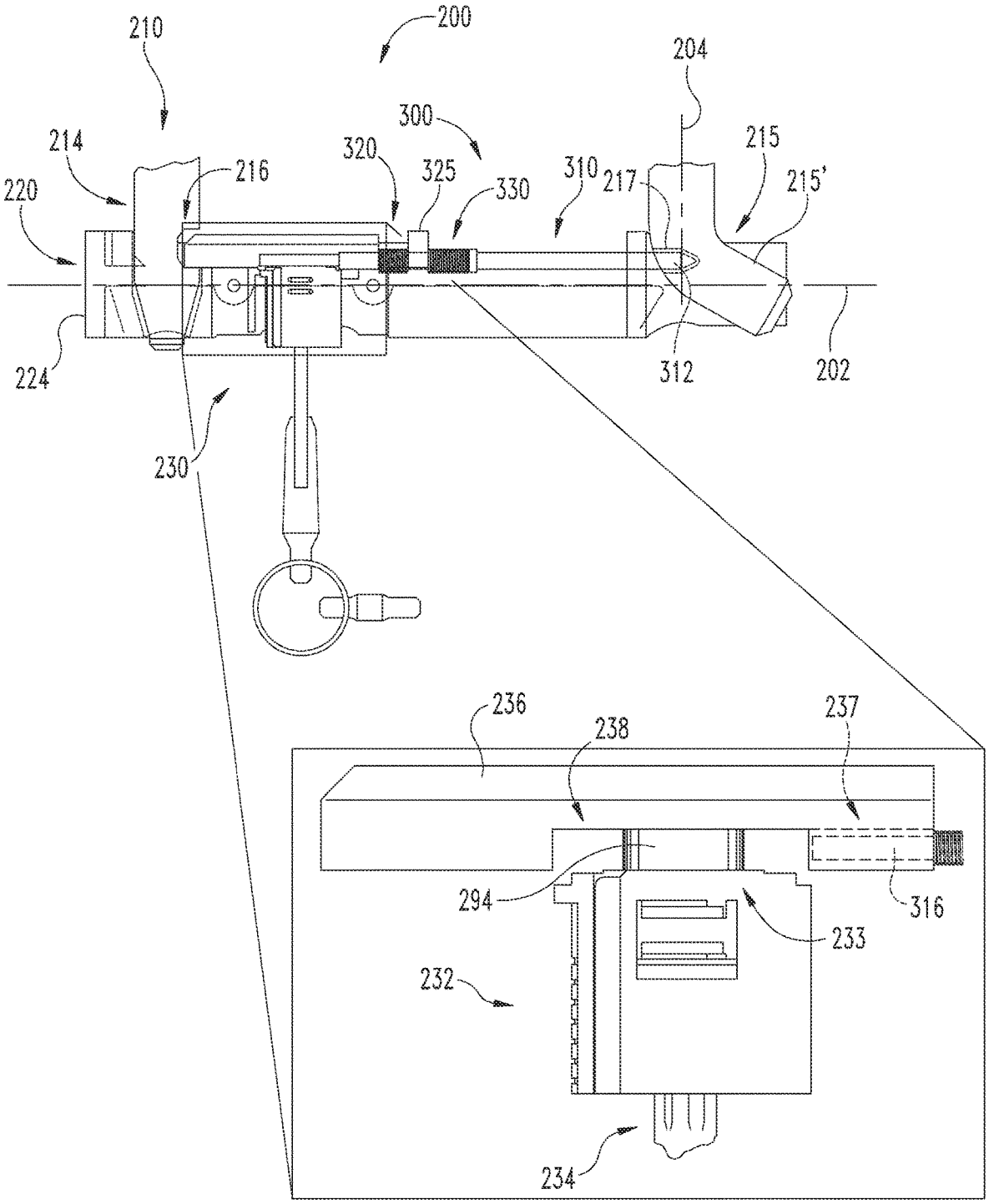
FIG. 5 is a side sectional view of a portion of the lock assembly illustrated in FIG. 3 in a coupled-unlocked state.

With specific reference to FIG. 5, the plunger 310 is slidably supported by the housing 224. The housing 224 includes a wall 225 positioned between the deadbolt 236 and the shoulder 314. The springs 320, 330 are engaged with the wall 225 and urge the deadbolt 236 and the plunger 310 toward extended positions. The deadbolt spring 320 is compressed between the wall 225 and the deadbolt 236 and proximally urges the deadbolt 236 toward the proximal foot 214. The plunger spring 330 is compressed between the wall 225 and the shoulder 314 and distally urges the plunger 310 toward the distal foot 215.

In the configuration illustrated in FIG. 5, the cam 233 is in the unlocking position, thereby defining the unlocking states of the locking mechanisms 230, 250. In the unlocking position, the cam 233 is seated in the deadbolt recess 238 with the smaller width dimension 294 generally aligned with the length dimension 293 of the recess 238. As such, each of the deadbolt 236 and the plunger 310 can be moved from the extended position to the refracted position. More specifically, the deadbolt 236 can be moved distally against the biasing the force of the deadbolt spring 320 from the extended deadbolt position toward the retracted deadbolt position. This in turn defines the unlocking state of the primary locking mechanism 230, or the primary unlocking state. Similarly, the plunger 310 can be moved proximally against the biasing force of the plunger spring 330 from the extended plunger position to the retracted plunger position. This in turn defines the unlocking state of the secondary locking mechanism 250, or the secondary unlocking state. The deadbolt 236 and/or the plunger 310 may abut the cam 233 when in the retracted position.

In order to couple the shackle 210 to the crossbar 220, the distal foot 215 is first inserted into the housing 224 through the distal openings 245, 265 in the tube 240 and the tube cover 260. As the distal foot 215 enters the crossbar 220, the angled portion 215' engages the distal plunger end 312, thereby urging the plunger 310 in the proximal direction against the biasing force of the plunger spring 330. With the distal foot 215 received in the crossbar 220, the shackle 210 is in the pivoted position, and the proximal foot 214 is generally aligned with the proximal tube opening 244. With the locking mechanisms 230, 250 in the unlocking states and the shackle 210 in the pivoted position, the lock assembly 200 is in a transitional-uncoupled state.

When in the transitional-uncoupled state, the lock assembly 200 can be moved to a coupled-unlocked state by pivoting the shackle 210 along the X-Y plane, or about a transverse axis, in a coupling direction (counter-clockwise in FIG. 5). As the shackle 210 pivots in the coupling direction, the proximal foot 214 enters the crossbar 220 and the deadbolt 236 is urged in the distal direction by the tapered toe 218. As the shackle 210 continues to pivot, the groove 216 in the proximal foot 214 becomes aligned with the deadbolt 236, and the recess 217 in the distal foot 215 becomes aligned with the plunger 310. When this occurs, the deadbolt spring 320 urges the proximal end of the deadbolt 236 into the groove 216, and the plunger spring 330 urges the distal plunger end 312 into the recess 217. The deadbolt 236 and plunger 310 are thus in the extended positions, as illustrated in FIG. 5. With the shackle 210 in the home position, the deadbolt 236 and plunger 310 in the extended positions, and the cam 233 in the unlocking position, the lock assembly 200 is in a coupled-unlocked state.

FIG. 5 illustrates the lock assembly 200 in the coupled-unlocked state wherein the shackle 210 is releasably coupled to the crossbar 220. The coupled-unlocked state includes the home shackle position, the primary unlocking state, and the secondary unlocking state. While the extended deadbolt 236 and plunger 310 resist movement of the shackle 210, the shackle 210 can nonetheless be pivoted along the X-Y plane in a decoupling direction (clockwise in FIG. 5). As the shackle 210 pivots toward the pivoted position, the deadbolt 236 and plunger 310 are moved toward the retracted positions as the proximal foot 214 exits the crossbar 220. After the proximal foot 214 exits the crossbar 220, the lock assembly 200 is in the transitional-unlocked state, which includes the pivoted shackle position and the secondary unlocking state. In this state, the distal foot 215 can be removed from the crossbar 220 to move the lock assembly 200 to the decoupled state.

Figure 6:
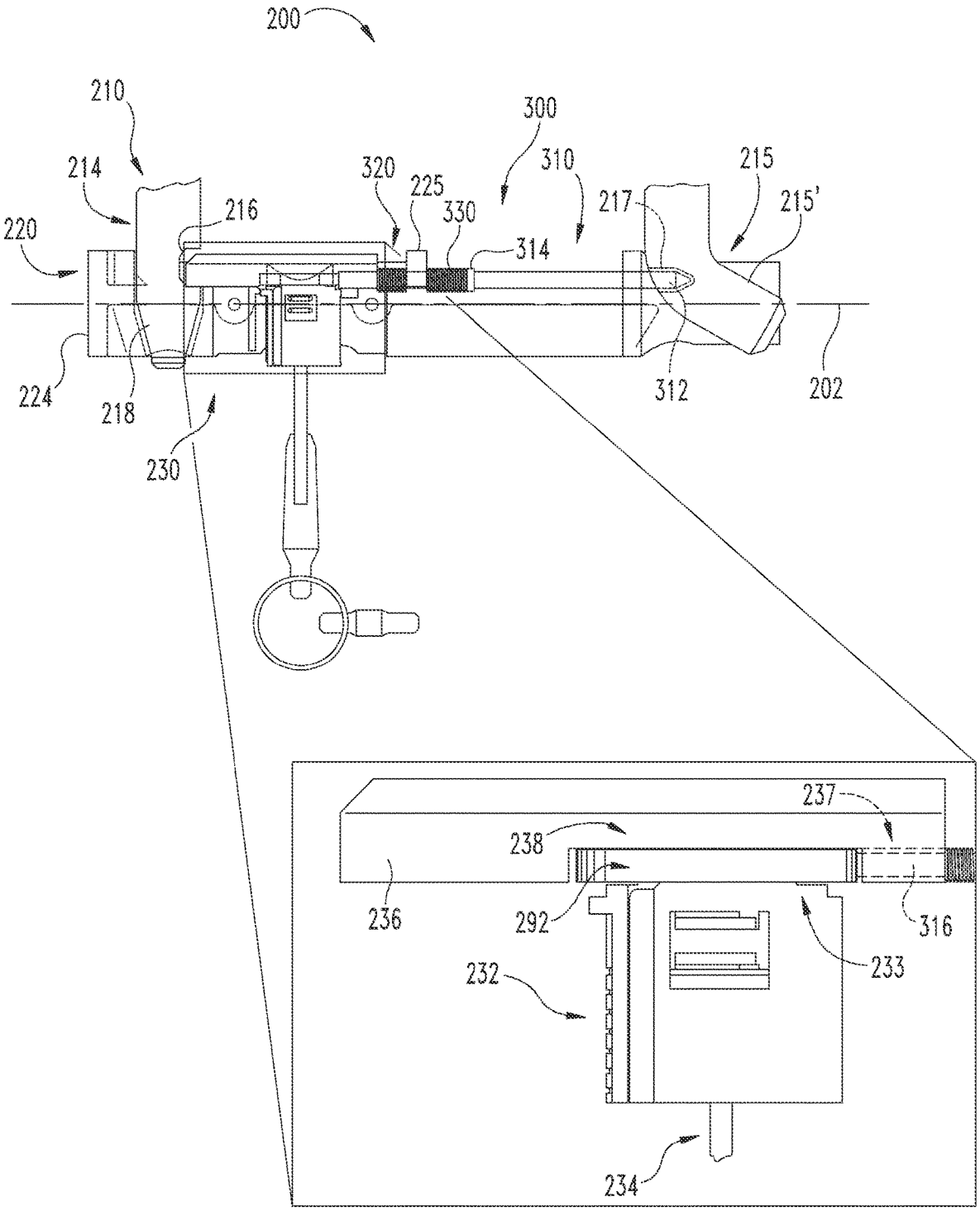
FIG. 6 is a side sectional view of a portion of the lock assembly illustrated in FIG. 3 in a coupled-locked state.
Figure 7:
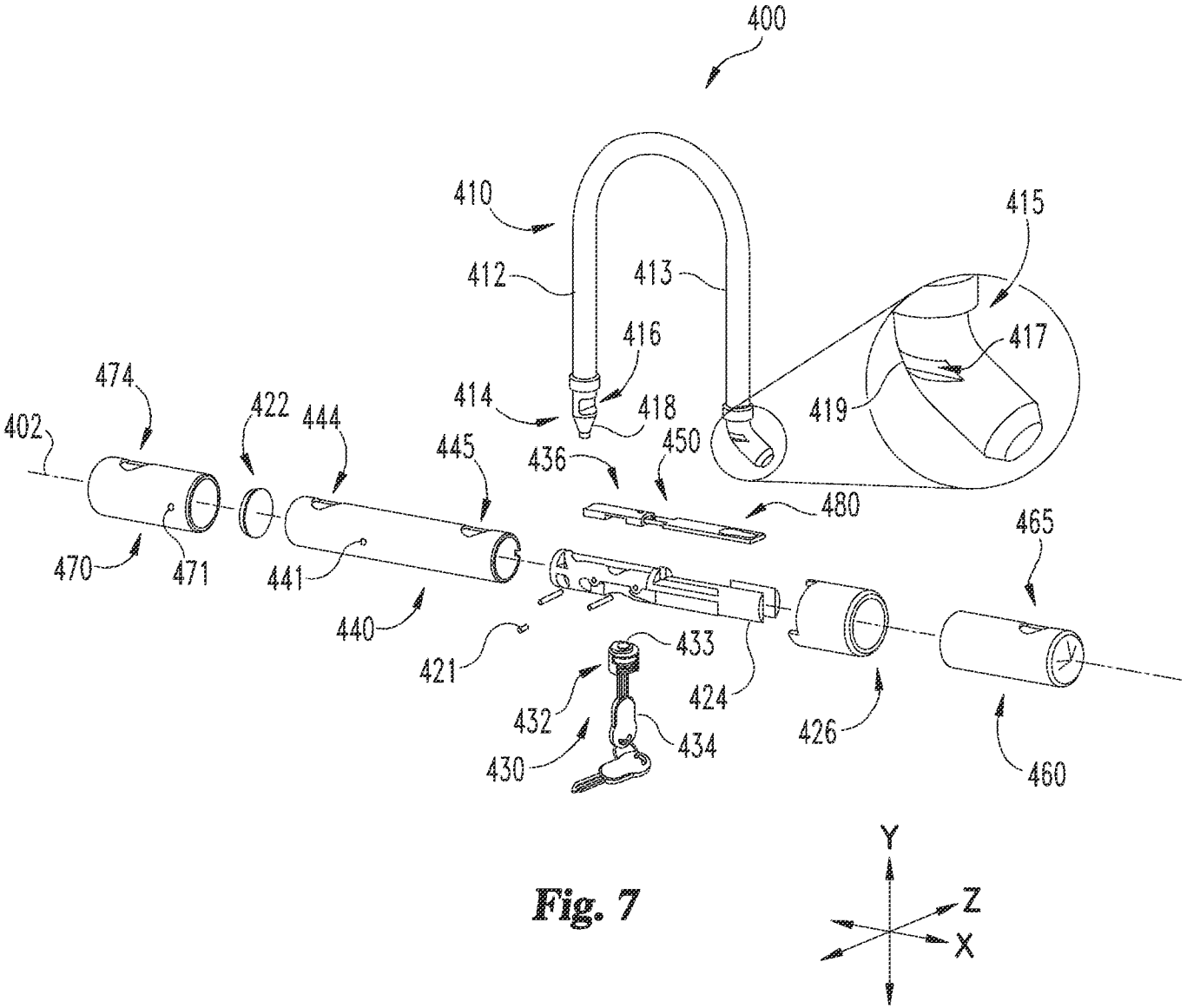
FIG. 7 is an exploded assembly illustration of a lock assembly according to another embodiment.

FIG. 6 illustrates the lock assembly 200 in a coupled-locked state in which the shackle 210 is securely coupled to the crossbar 220. The cam 233 has been rotated by the key 234 from the unlocking position to the locking position, thereby placing the locking mechanisms 230, 250 in the locking states. The coupled-locked state thus includes the home shackle position, the primary locking state, and the secondary locking state. With the primary locking mechanism 230 in the locking state, the length dimension 292 of the cam 233 is aligned with the length dimension 293 of the recess 238. Due to the fact that the length dimension 293 of the recess 238 is substantially equal to the length dimension 292 of the cam 233, the cam 233 substantially prevents retraction of the deadbolt 236. In other words, while the deadbolt 236 may be capable of slight movement in the retracting direction, it cannot exit the groove 216, and thereby remains engaged with the proximal foot 214.

In the locking position, the cam 233 also limits movement of the plunger 310 in the proximal direction, thereby preventing the distal plunger end 312 from being removed from the recess 217 in the distal foot 215. With the distal plunger end 312 received in the recess 217 and the plunger 310 unable to retract, the distal leg 213 is unable to pivot. Additionally, with the deadbolt 236 and the plunger 310 unable to move to the retracted positions, the primary locking mechanism 230 and the secondary locking mechanism 250 are in the locking states, thereby preventing removal of the shackle 210 from the crossbar 220.

The lock assembly 200 may be used to secure a portable object to a stationary object such as, for example, to prevent theft of the portable object. A common form of attack on U-locks (such as the lock assembly 200) is to form a cut in the shackle 210, and to enlarge the cut into a gap by moving the legs 212, 213 away from one another. If this were to occur with the lock assembly 200 in the coupled-locked state, the cam 233 would nonetheless retain the deadbolt 236 and the plunger 310 in the extended positions such that neither the proximal foot 214 nor the distal foot 215 can be removed from the crossbar 220. As such, each of the legs 212, 213 remains coupled to the crossbar 220. Additionally, with pivoting of the distal leg 213 substantially prevented by the locking mechanism 250, the maximum size of the gap may be limited to a size wherein neither of the objects can be passed through the gap. In such case, the attacker must cut the shackle 210 a second time in order to decouple the portable object from the stationary object With specific reference to FIGS. 7-11, a lock assembly 400 according to another embodiment includes a shackle 410 having a straight proximal foot 414 and an angled distal foot 415. The proximal foot 414 includes a transverse groove 416, and the distal foot 415 includes a pair of longitudinal grooves 417 which define a neck or narrowed section 419 of the distal foot 415. The lock assembly 400 also includes a crossbar 420 including a primary locking mechanism 430 and a secondary locking mechanism 450. The primary locking mechanism 430 is operable to engage the proximal foot 414, and the secondary locking mechanism 450 is operable to engage the distal foot 415.

The shackle 410 is operable in a plurality of operational positions with respect to the crossbar 420, including the above-described removed, pivoted, and home positions. Additionally, the lock assembly 400 is operable in a plurality of states, including at least a decoupled state including the removed shackle position, a transitional state including the pivoted shackle position, and a coupled state including the home shackle position.

The primary locking mechanism 430 has a primary locking state in which the primary locking mechanism 430 is operable to retain the proximal foot 414 within the crossbar 420, and a primary unlocking state in which the primary locking mechanism 430 is not operable to prevent removal of the proximal foot 414 from the crossbar 420. Similarly, the secondary locking mechanism 450 has a secondary locking state in which the secondary locking mechanism 450 is operable to retain the distal foot 415 in the crossbar 420, and a secondary unlocking state in which the secondary locking mechanism 450 is not operable to prevent removal of the distal foot 415 from the crossbar 420. As described in further detail below, the locked/unlocked state of each of the locking mechanisms 430, 450 is controlled by the lock cylinder 432 and the cam 433. When the proper key 434 is inserted in the lock cylinder 432, the cam 433 can be rotated to drive the locking mechanisms 430, 450 between the unlocking state (FIG. 9) and the locking state (FIG. 10).

Figure 8:
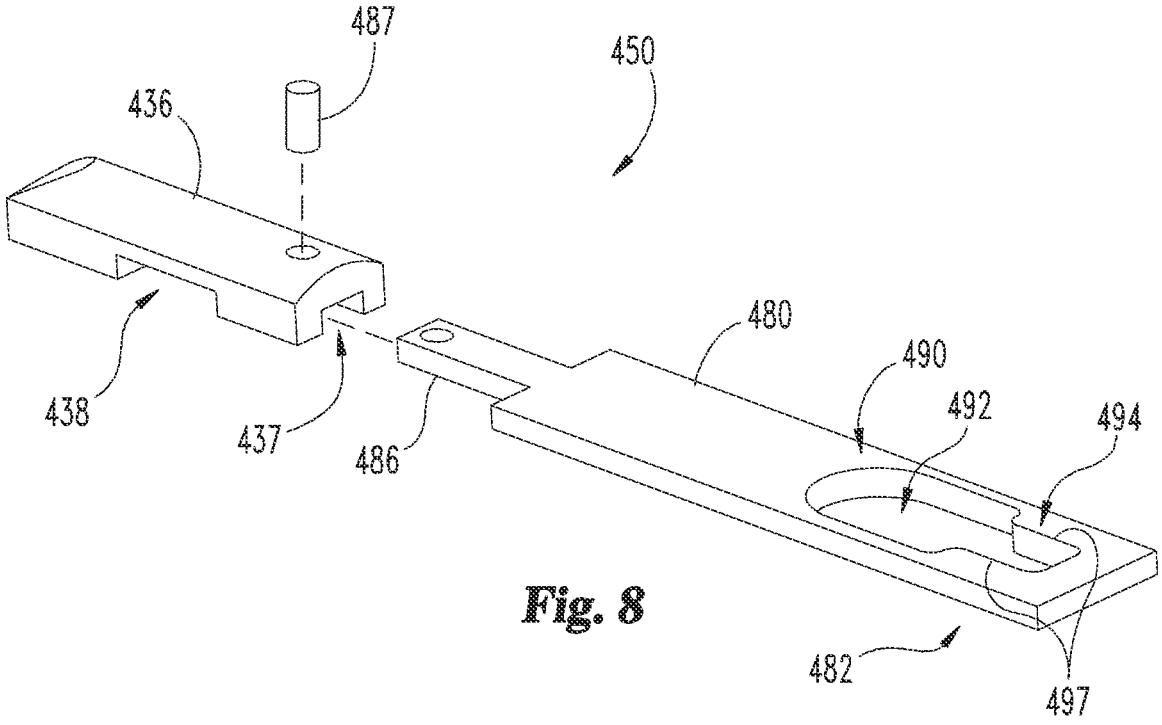
FIG. 8 is an exploded assembly illustration of a portion of the lock assembly illustrated in FIG. 7.

As illustrated in FIG. 8, the secondary locking mechanism 450 includes a locking plate 480 which is coupled with the deadbolt 436 for joint longitudinal movement therewith. For example, the plate 480 may include an arm 486 which extends into a channel 437 formed in the deadbolt 436, and the arm 486 may be coupled to the deadbolt 436 with a pin 487. The plate 480 also includes a distal end 482 in which an opening 490 is formed. The opening 490 generally includes an enlarged portion 492 sized and shaped to receive the distal foot 415, and a locking slot 494 defined in part by a pair of longitudinally extending edges 497. The locking slot 494 has a transverse dimension corresponding to that of the narrowed section 419, and the plate 480 has a lateral dimension corresponding to that of the grooves 417. As such, each of the edges 497 can be received in one of the grooves 417, and the narrowed section 419 can be received in the locking slot 494.

Figure 9:
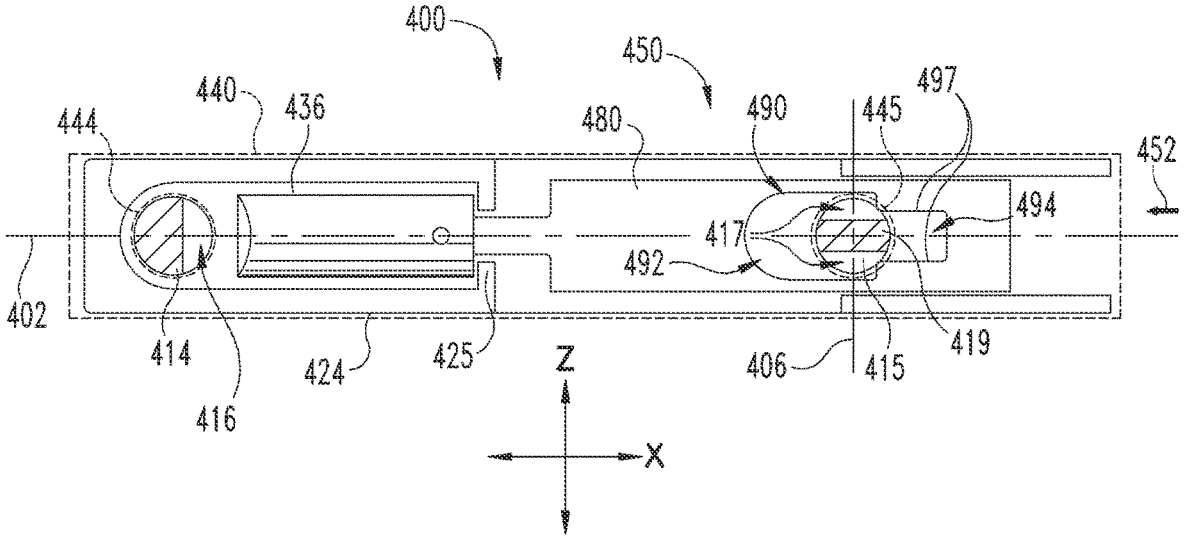
FIG. 9 is a top sectional view of the lock assembly illustrated in FIG. 7 in a coupled-unlocked state.
Figure 10:
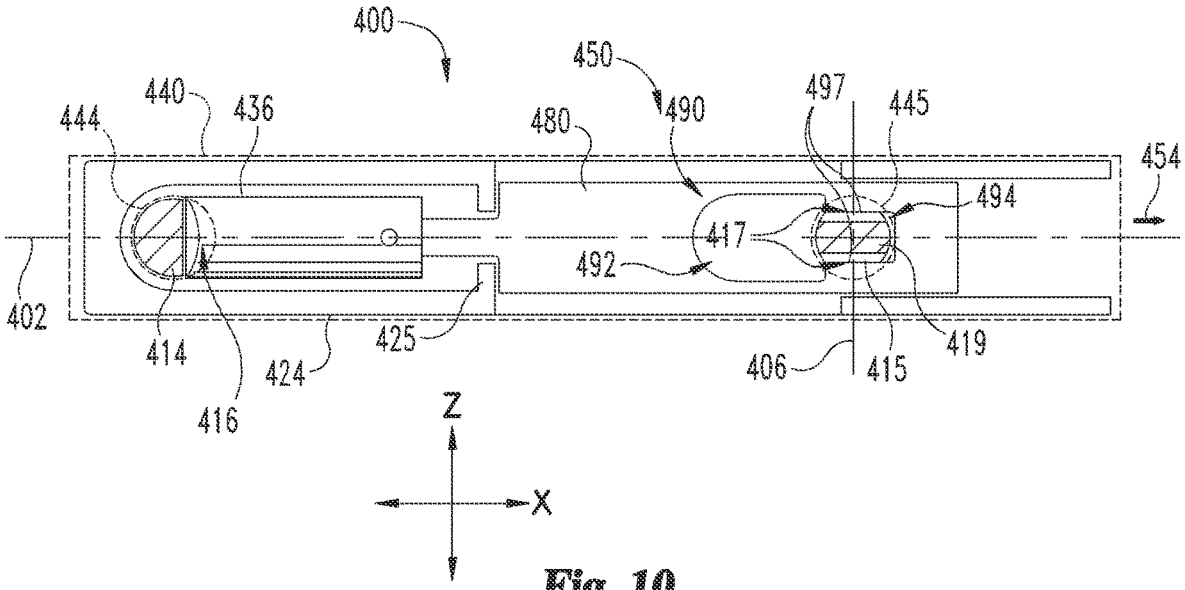
FIGS. 10 and 11 depict the lock assembly illustrated in FIG. 7 in a coupled-locked state.

FIG. 9 illustrates the lock assembly 400 in the coupled-unlocked state in which the shackle 410 is in the home position, and each of the locking mechanisms 430, 450 is in the unlocking state. With the primary locking mechanism 430 in the primary unlocking state, the deadbolt 436 is in a retracted position, and is not engaged with the proximal foot 414. With the secondary locking mechanism 450 in the secondary unlocking state, the enlarged portion 492 of the opening 490 is generally aligned with the distal tube opening 445. Additionally, the narrowed section 419 is received in the enlarged portion 492 and is generally aligned with the locking slot 494, and the edges 497 of the locking slot 494 are generally aligned with the grooves 417. With the narrowed section 419 received in the enlarged portion 492, the shackle 410 is free to pivot about a transverse axis 406 in a decoupling direction to remove the proximal foot 414 from the crossbar 420.

When in the coupled-unlocked state, the lock assembly 400 can be moved to a coupled-locked state by rotating the cam 433 from the unlocking position to the locking position. As the cam 433 rotates to the locking position, the cam 433 urges the deadbolt 436 and the plate 480 in a proximal locking direction 452. As the deadbolt 436 moves in the locking direction 452, the proximal end thereof enters the groove 416 in the proximal foot 414. As the plate 480 moves in the locking direction 452, the narrowed section 419 enters the locking slot 494 and the slot edges 497 enter the longitudinal grooves 417.

Figure 11:
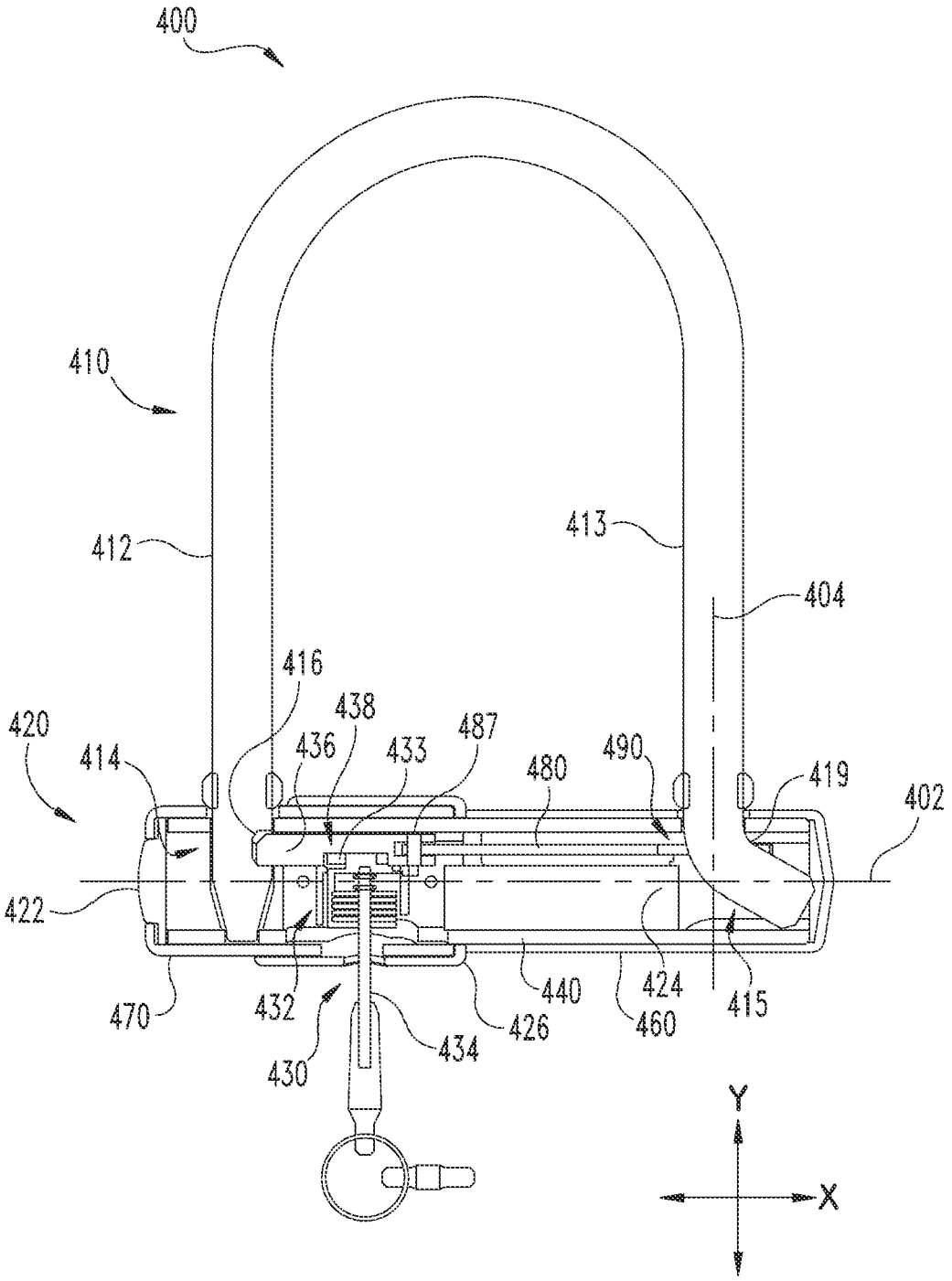
Figure 12:
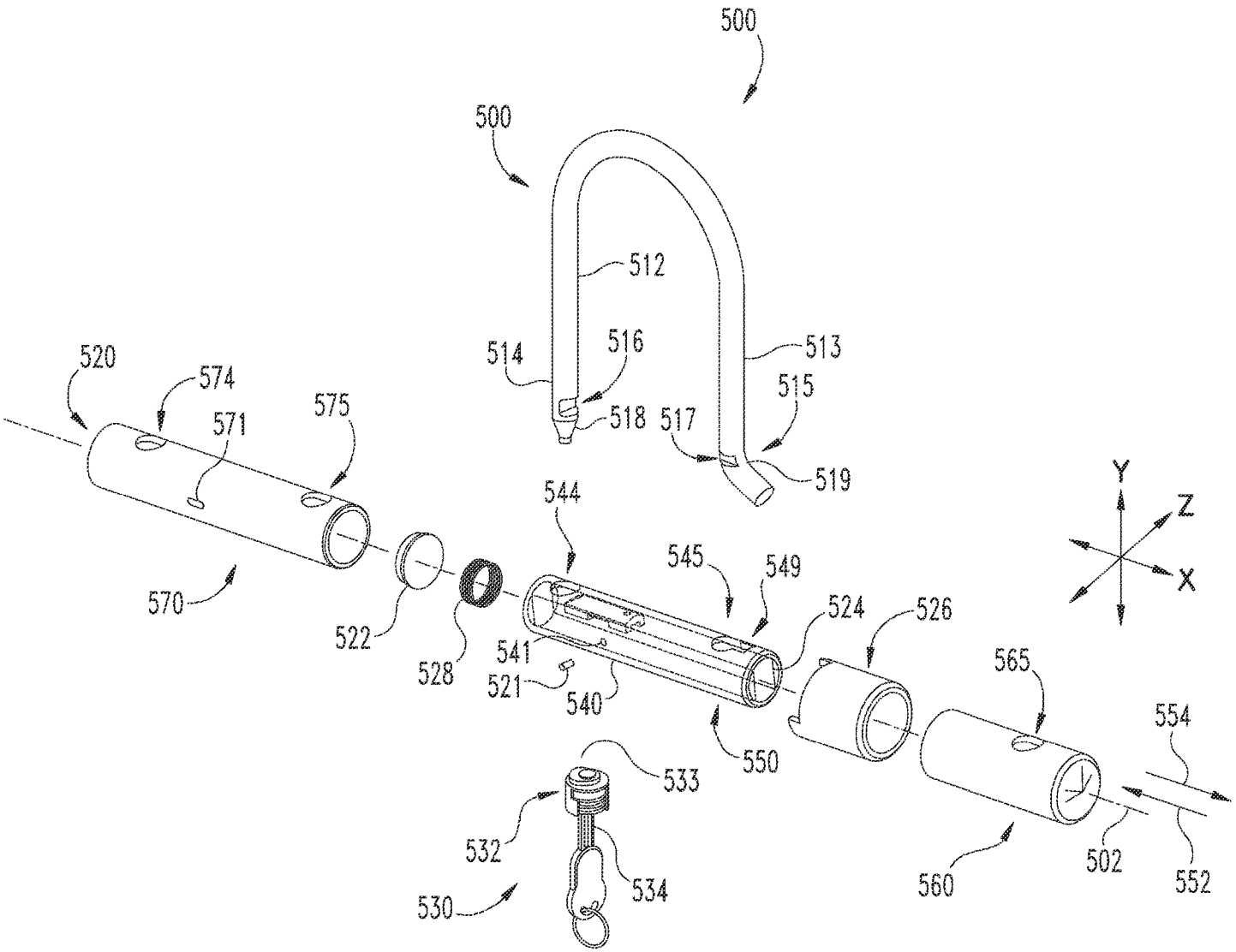
FIG. 12 is an exploded assembly illustration of a lock assembly according to another embodiment.

FIGS. 10 and 11 illustrate the lock assembly 400 in the coupled-locked state in which each of the locking mechanisms 430, 450 is in the locking state. With the primary locking mechanism 430 in the primary locking state, the deadbolt 436 is in an extended position and is engaged with the proximal foot 414. With the secondary locking mechanism 450 in the secondary locking state, the locking slot 494 is generally aligned with the distal tube opening 445 and the narrowed section 419 of the distal foot 415 is received in the locking slot 494. Additionally, the edges 497 of the locking slot 494 are received in the grooves 417 such that the distal foot 415 is keyed to the plate 480. When the key 434 is removed from the lock cylinder 432, the cylinder 432 rotationally locks the cam 433, thereby substantially preventing movement of the deadbolt 436 and the plate 480 in a distal unlocking direction 454. With distal movement substantially prevented, the deadbolt of the deadbolt 436 and the plate 480 may permissibly be capable of slight movement in the unlocking direction 454 so long as the deadbolt 436 and plate 480 are not moved to the retracted or unlocking positions thereof.

In the illustrated form, the lateral dimension of the plate 480 is substantially equal to that of the longitudinal grooves 417. As a result, the plate 480 substantially prevents lateral and pivotal movement of the distal leg 413 when the distal foot 415 is keyed to the plate 480. In other embodiments, the lateral dimension of the plate 480 may be slightly less than that of the longitudinal grooves 417. In such embodiments, the plate 480 may limit pivoting of the distal leg 413 when keyed to the distal foot 415, as opposed to substantially preventing pivotal movement thereof.

When in the coupled-locked state illustrated in FIGS. 10 and 11, the lock assembly 400 can be moved to the coupled-unlocked state by inserting the key 434 into the lock cylinder 432 and rotating the key 434. As the key 434 rotates, the cam 433 is rotated from the locking position to the unlocking position. As the cam 433 rotates within the recess 438, the cam 433 urges the deadbolt 436 and the plate 480 in the distal unlocking direction 454. When the cam 433 reaches the unlocking position, the deadbolt 436 and plate 480 are in the unlocking positions illustrated in FIG. 9. As a result, each of the locking mechanisms 430, 450 are in the unlocking states. In the coupled-unlocked state, the lock assembly 400 can be moved to a transitional-uncoupled state by pivoting the shackle 410 in along the X-Y plane from the home position to the pivoted position. When in the transitional-uncoupled state, the lock assembly 400 can be moved to the decoupled state by removing the distal foot 415 from the crossbar 420, thereby moving the shackle 410 from the pivoted position to the removed position.

If the shackle 410 were to be cut with the lock assembly 400 in the coupled-locked state, the cam 433 would nonetheless retain the deadbolt 436 and the locking plate 480 in the locking positions such that neither the proximal foot 414 nor the distal foot 415 can be removed from the crossbar 420. As such, each of the legs 412, 413 remains coupled to the crossbar 420. Additionally, with pivoting of the distal leg 413 substantially prevented by the secondary locking mechanism 450, the maximum size of the gap may be limited to a size at which neither of the objects secured by the lock assembly 400 can be passed through the gap. In such case, the attacker must cut the shackle 410 a second time in order to decouple the portable object from the stationary object.

FIGS. 12-33 depict lock assemblies according to further embodiments. Each of the following lock assemblies includes a shackle and a crossbar selectively coupled to the shackle. Each of the crossbars includes a first tube or base pipe, and a second tube or locking pipe movably coupled to the base pipe. In the illustrated embodiments, each of the tubes or pipes has a circular cross-section. It is also contemplated that in other embodiments, the tubes may have non-circular cross-sections such as, for example, elliptical or polygonal cross-sections.

With specific reference to FIGS. 12-17, a lock assembly 500 according to another embodiment includes a shackle 510 and a crossbar 520. The shackle 510 is structured and configured substantially similar to the shackle 410 and includes a straight proximal foot 514 having a transverse groove 516, and an angled distal foot 515 having a pair of longitudinal grooves 517. The longitudinal grooves 517 define a narrowed section 519 of the distal foot 515. The crossbar 520 includes a primary locking mechanism 530 operable to engage the proximal foot 514, and a secondary locking mechanism 550 operable to engage the distal foot 515.

As described in further detail below, the shackle 510 is operable in a plurality of operational positions, including a removed position, a pivoted position, and a home position. In the removed position (FIG. 12), neither the proximal foot 514 nor the distal foot 515 is received in the crossbar 520. In the pivoted position (FIGS. 13 and 14), the distal foot 515 is received in the crossbar 520, and the proximal foot 514 is not received in the crossbar 520. In the home position (FIGS. 15-17), both the proximal foot 514 and the distal foot 515 are received in the crossbar 520. Additionally, the lock assembly 500 is operable in a plurality of states including a decoupled state (FIG. 12), a transitional-uncoupled state (FIGS. 13 and 14), a transitional-coupled state, a coupled-unlocked state (FIGS. 15 and 16), and a coupled-locked state (FIG. 17).

The crossbar 520 includes a first tube or base pipe in the form of a sleeve 570 or outer tube. The crossbar 520 may also include a sleeve cover 560 mounted on a distal end of the sleeve 570, and an end cap 522 seated in a proximal end of the sleeve 570. The sleeve 570 includes a proximal opening 574 sized and shaped to receive the proximal foot 514, and a distal opening 575 sized and shaped to receive the distal foot 515. The sleeve openings 574, 575 are longitudinally spaced from one another by a distance corresponding to the longitudinal distance between the feet 514, 515. As a result, the sleeve openings 574, 575 are operable to concurrently receive the proximal foot 514 and the distal foot 515. As used herein, the term "concurrently receive" means that with the distal foot 515 positioned in the distal sleeve opening 575, the proximal foot 514 can be positioned in the proximal sleeve opening 574. However, it should be understood that the feet 514, 515 need not enter the openings 574, 575 at the same time in order to be "concurrently received" in the openings 574, 575.

The crossbar 520 also includes the secondary locking mechanism 550 which generally includes a second tube or locking pipe in the form of a tube 540 or inner tube. The tube 540 is slidably mounted in the sleeve 570 and includes a proximal opening 544 sized and shaped to receive the proximal foot 514, and a distal opening 545 sized and shaped to receive the distal foot 515. The tube 540 also includes a locking slot 549 which is sized and shaped to receive the narrowed section 519 of the distal foot 515. The tube openings 544, 545 are longitudinally offset from one another by a lesser distance than the longitudinal distance between the feet 514, 515. The locking slot 549 extends distally from the distal opening 545 such that the proximal foot 514 can be received in the proximal tube opening 544 when the distal foot narrowed section 519 is received in the locking slot 549.

The radial thickness of the tube 540 is slightly less than a lateral dimension of the grooves 517. As a result, when the distal foot 515 is keyed to the tube 540, pivoting of the shackle 510 is limited, but is not prevented. More specifically, when the narrowed section 519 is received in the locking slot 549, engagement between the walls defining the grooves 517 and the edges of the locking slot 549 substantially limits pivoting of the shackle 510. The relative dimensions of the tube 540 and grooves 517 may be selected such that when the distal foot 515 is keyed to the tube 540, pivoting of the shackle 510 is substantially limited to a predetermined pivotal range. Further details regarding such a feature are provided below with reference to FIGS. 34 and 35.

The tube or locking pipe 540 is longitudinally movable between a locking position and an unlocking position. When in the unlocking position, the distal tube opening 545 is generally aligned with the distal sleeve opening 575, and the proximal tube opening 544 is longitudinally offset from the proximal sleeve opening 574. In the locking position, the proximal tube opening 544 is generally aligned with the proximal sleeve opening 574, and at least a portion of the locking slot 549 is generally aligned with the distal sleeve opening 575.

The tube 540 is movable between the locking position and the unlocking position along a longitudinal locking path which defines a locking direction 552 and an opposite unlocking direction 554. More specifically, the tube 540 is movable along the locking path in the locking direction 552 from the unlocking position to the locking position, and is movable along the locking path in the unlocking direction 554 from the locking position to the unlocking position. The locking slot 549 extends from the distal opening 545 in the unlocking direction 554 such that the locking slot 549 becomes generally aligned with the distal sleeve opening 575 as the tube 540 moves toward the locking position. In the illustrated form, the locking direction 552 is the proximal direction and the unlocking direction 554 is the distal direction. In other forms, the locking direction 552 and the unlocking direction 554 may be reversed. In further embodiments, the locking direction 552 and unlocking direction 554 need not be longitudinal directions, and may include rotational directions.

The secondary locking mechanism 550 may also include a biasing element, such as a spring 528, urging the tube 540 toward the unlocking position. In the illustrated form, the spring 528 is seated between the end cap 522 and the proximal end of the tube 540. The end cap 522 provides an anchor for the proximal end of the spring 528 such that the spring 528 urges the tube 540 in the distal direction when compressed. With the locking pipe or tube 540 biased toward the unlocking position, the secondary locking mechanism 550 is biased toward the unlocking state. Additionally, the sleeve 570 may include a guide slot 571, and a pin 521 may extend into the guide slot 571 from the tube 540. With the pin 521 received in the guide slot 571, the pin 521 limits longitudinal movement of the tube 540 with respect to the sleeve 570, and rotationally couples the tube 540 and the sleeve 570. The pin 521 and the guide slot 571 may cooperate to limit the tube 540 to movement between the locking and unlocking positions and along the locking path.

In the illustrated form, the tubular element of the secondary locking mechanism 550 is an inner locking pipe in the form of the tube 540 which is movably mounted within an outer tubular element in the form of the sleeve 570. It is also contemplated that the locking pipe of the secondary locking mechanism 550 may be an outer tubular element such as the sleeve 570, and an inner base pipe such as the tube 540 may be movably mounted within the outer locking pipe. Exemplary forms of such embodiments are described in further detail below with reference to the locks 600, 700 illustrated in FIGS. 18-33.

Figure 13:
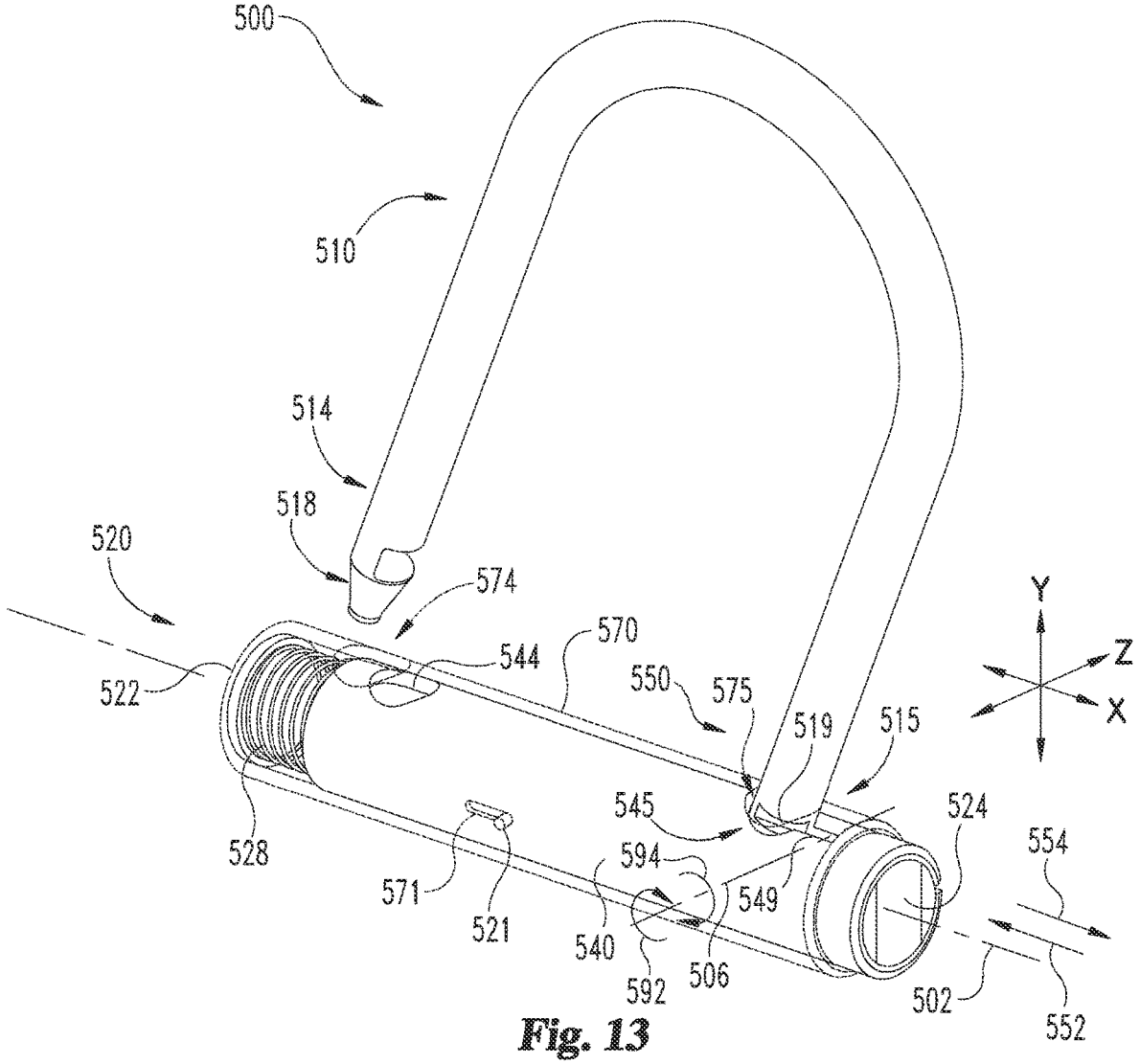
FIGS. 13 and 14 depict the lock assembly illustrated in FIG. 12 in a transitional-uncoupled state.
Figure 14:
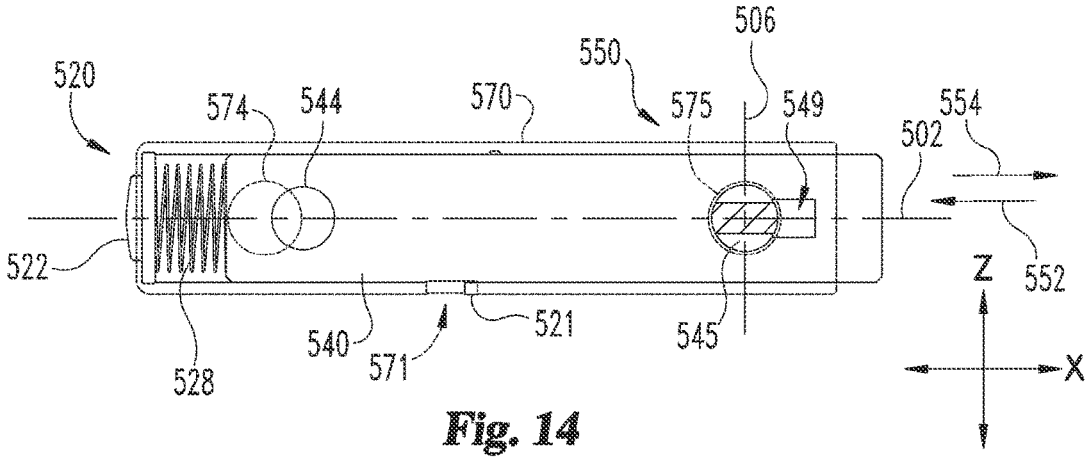

FIGS. 13 and 14 illustrate the lock assembly 500 in the transitional-uncoupled state in which the shackle 510 is in the pivoted position and the tube 540 is in the unlocking position. Thus, the transitional-uncoupled state includes the pivoted position and the secondary unlocking state. With the tube 540 in the unlocking position, the proximal sleeve opening 574 overlaps the proximal tube opening 544, but the openings 544, 574 are not aligned. More specifically, the proximal sleeve opening 574 is offset from the proximal tube opening 544 in the locking direction 552. As such, the tube 540 must be moved in the locking direction 552 in order for the proximal openings 544, 574 to become generally aligned.

In the transitional-uncoupled state, the narrowed section 519 of the distal foot 515 is positioned at least partially in the distal tube opening 545, and a distal end thereof is generally aligned with the locking slot 549. The lock assembly 500 can be moved from the transitional-uncoupled state to the coupled-unlocked state by pivoting the shackle 510 about a transverse axis 506 in a coupling direction 594. As the shackle 510 pivots along the X-Y plane in the coupling direction 594, the proximal foot 514 begins to enter the crossbar 520 through the proximal sleeve opening 574. As the proximal foot 514 enters the crossbar 520, the tapered toe 518 engages the edge of the proximal tube opening 544, thereby urging the tube 540 in the locking direction 552. As the tube 540 travels toward the locking position, the narrowed section 519 of the distal foot 515 enters the locking slot 549. When the tube 540 reaches the locking position, at least a portion of the narrowed section 519 is received in the locking slot 549, thereby defining the locking state of the secondary locking mechanism 550.

In the illustrated form, the tube 540 is configured to move from the unlocking position to the locking position in response to rotation of the shackle 510 from the pivoted position to the home position. As a result, the lock assembly 500 automatically moves from the transitional-uncoupled state to the coupled-unlocked state in response to pivoting of the shackle 510 from the pivoted position to the home position. In other embodiments, the tube 540 may be moved from the unlocking position to the locking position in another manner, which need not necessarily be in response to movement of the shackle 510.

Figure 15:
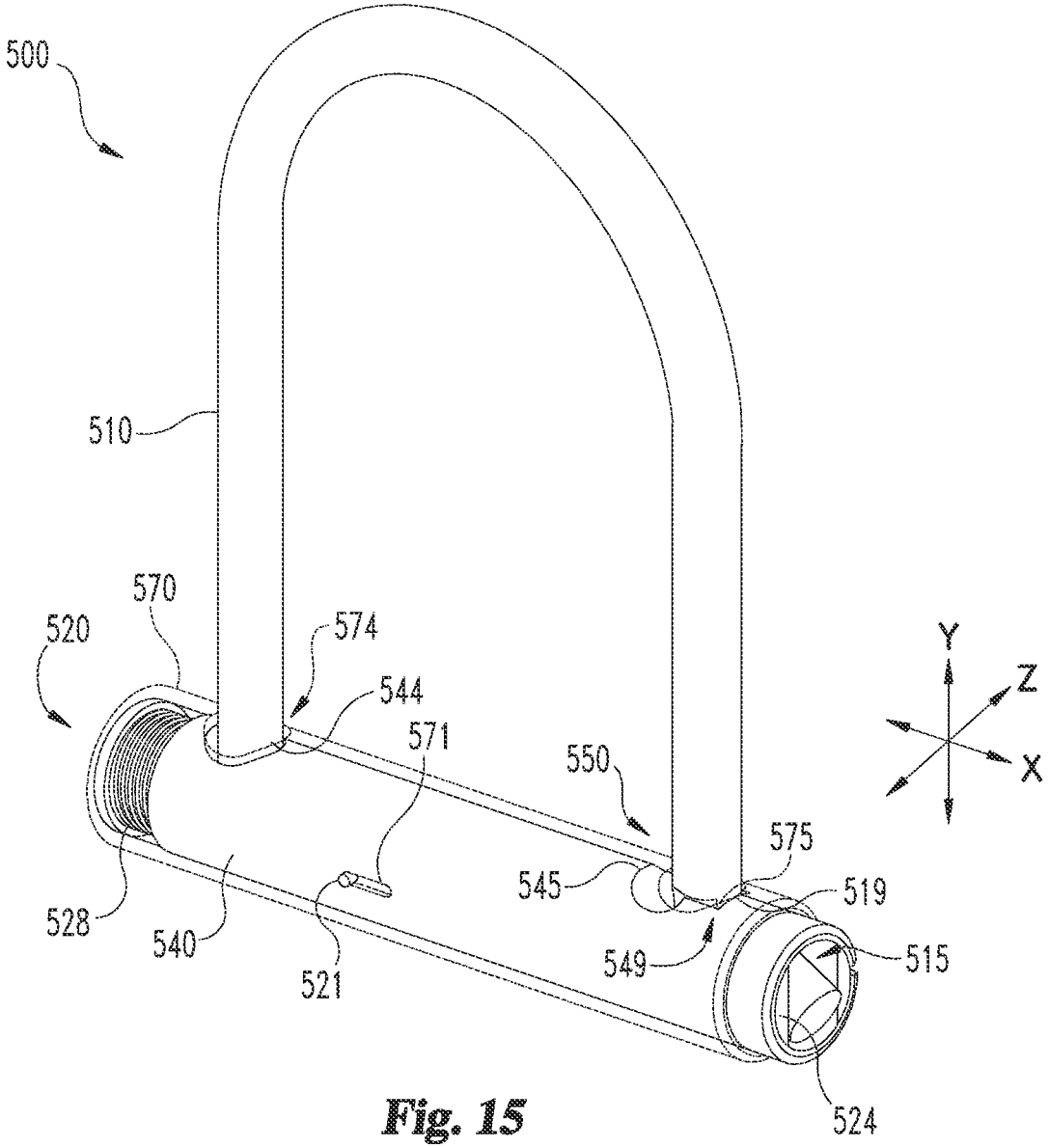
FIGS. 15 and 16 depict the lock assembly illustrated in FIG. 12 in a coupled-unlocked state.
Figure 16:
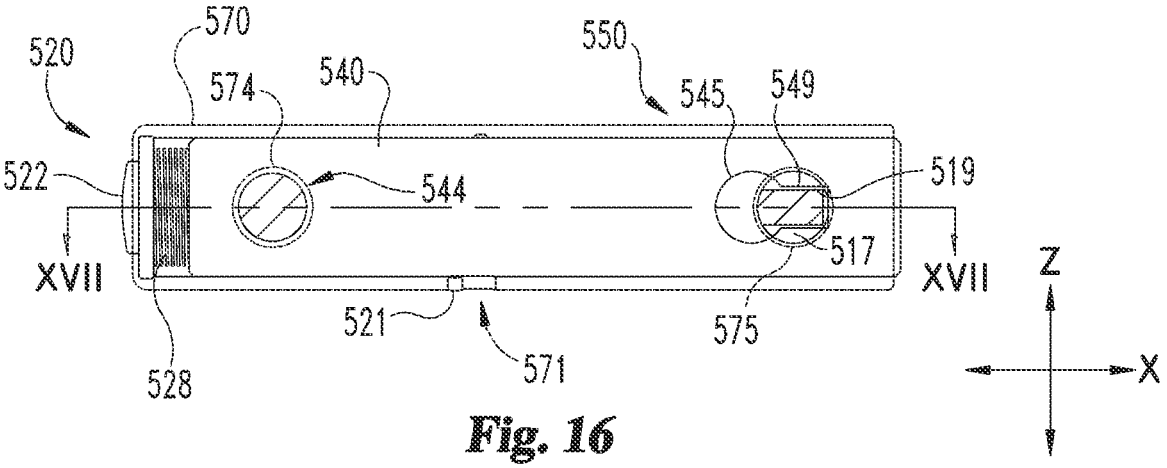
Figure 17:
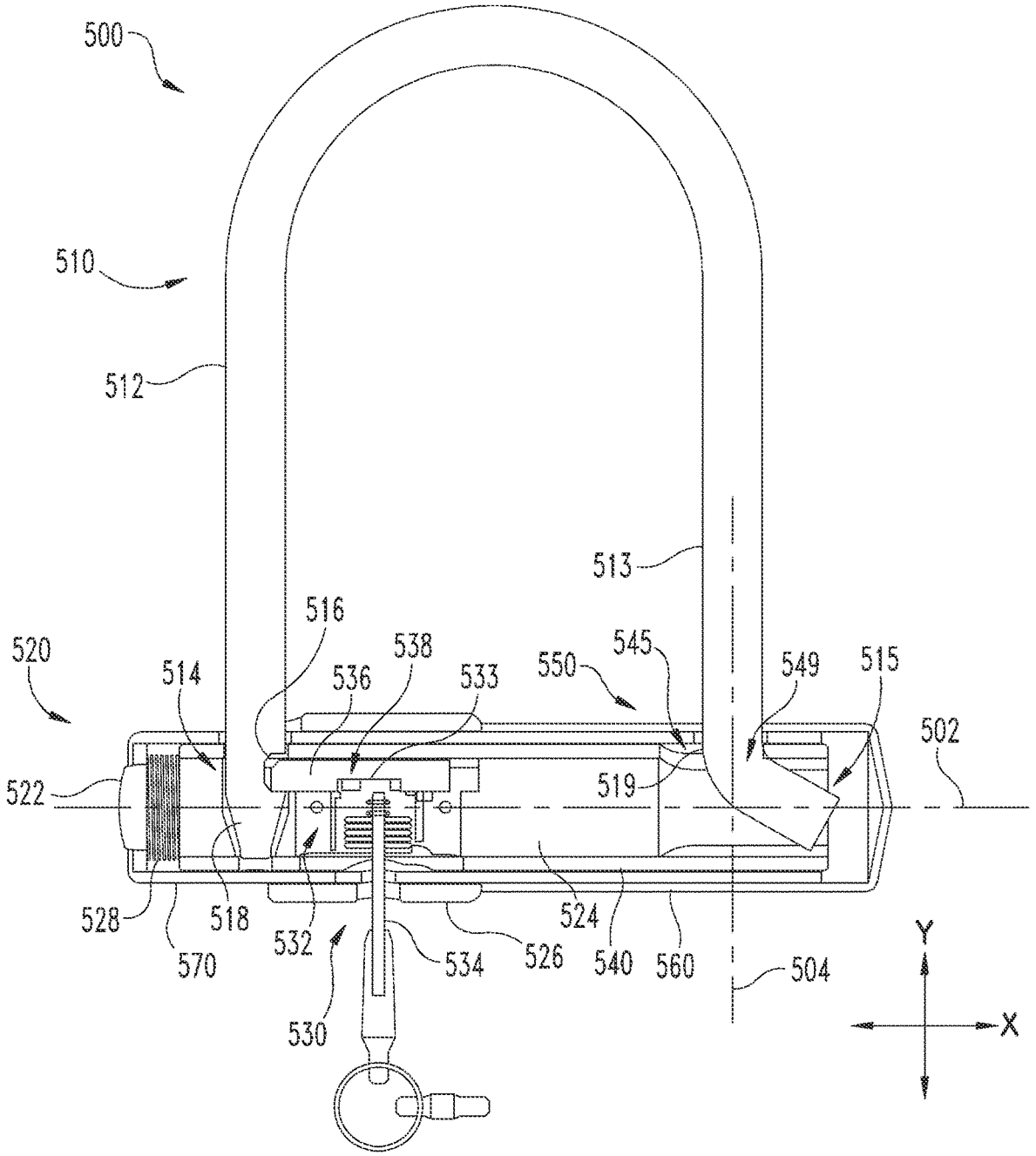
FIG. 17 is a side sectional view of the lock assembly illustrated in FIG. 12 in a coupled-locked state.
Figure 18:
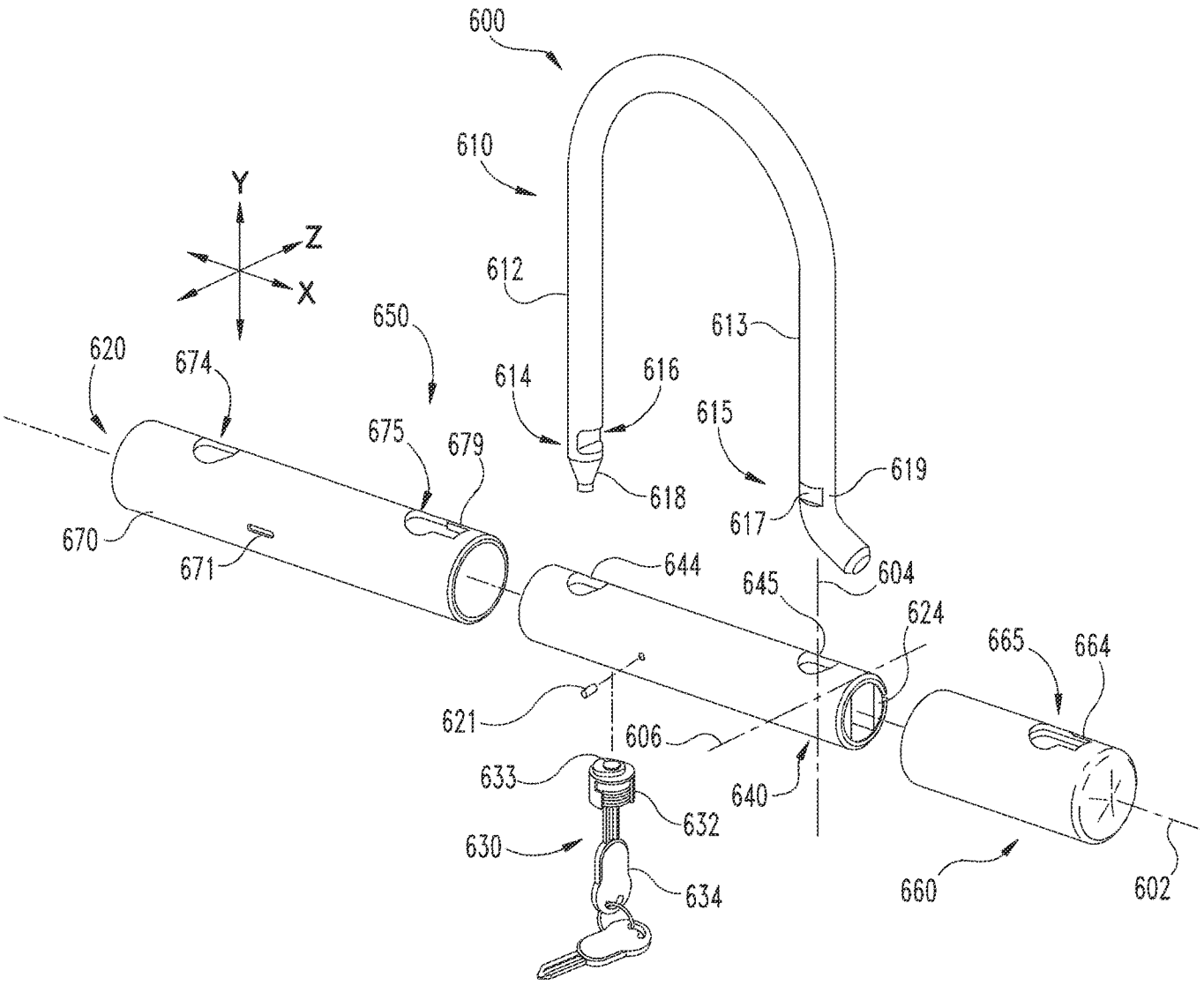
FIG. 18 is an exploded assembly illustration of a lock assembly according to another embodiment.

FIGS. 15 and 16 illustrate the lock assembly 500 in the coupled-unlocked state in which each of the feet 514, 515 is received in the crossbar 520, the tube 540 is in the locking position, and the primary locking mechanism 530 is in the unlocking state. Thus, the coupled-unlocked state includes the home shackle position, the primary unlocking state, and the secondary locking state. In this state, the narrowed section 519 is received in the locking slot 549, and the edges of the locking slot 549 are received in the longitudinal grooves 517. As noted above, the tube 540 substantially limits but does not prevent pivoting of the shackle 510 when the distal foot 515 is keyed to the tube 540. Additionally, with the primary locking mechanism 530 in the primary locking state, removal of the proximal foot 514 from the crossbar 520 is not prevented. As a result, the shackle 510 can be pivoted about the transverse axis 506 in the decoupling direction 592 to the pivoted position.

With the lock assembly 500 in the coupled-unlocked state, the primary locking mechanism 530 does not prevent removal of the proximal foot 514 from the crossbar 520, and the secondary locking mechanism 550 prevents removal of the distal foot 515 from the crossbar 520. With the proximal foot 514 extending through the openings 544, 574, the tube 540 is unable to move to the unlocking position. As such, the distal foot 515 cannot be removed from the crossbar 520 without first pivoting the shackle 510 in the decoupling direction 592 to remove the proximal foot 514 from the crossbar 520. When the shackle 510 pivots in the decoupling direction 592, the proximal foot 514 begins to exit the crossbar 520, and the spring 528 distally urges the tube 540 in the unlocking direction 554. When the proximal foot 514 is no longer received in the tube 540, the spring 528 urges the tube 540 to the unlocking position, thereby moving the lock assembly 500 to the transitional-uncoupled state.

FIG. 17 illustrates the lock assembly 500 in the coupled-locked state in which each of the feet 514, 515 is received in the crossbar 520, and each of the locking mechanisms 530, 550 is in the locking state. Thus, the coupled-locked state includes the home shackle position, the primary locking state, and the secondary locking state. In this state, the deadbolt 536 is engaged with the proximal foot 514 and prevents removal of the proximal foot 514 from the crossbar 520. Additionally, the secondary locking mechanism 550 is engaged with the distal foot 515 and prevents removal of the distal foot 515 from the crossbar 520. As such, the shackle 510 is securely coupled to the crossbar 520. The lock assembly 500 can be moved between the coupled-locked state and the coupled-unlocked state by operating the lock cylinder 532 to transition the primary locking mechanism 530 between the primary locking state and the primary unlocking state.

As should be appreciated, the lock assembly 500 may be moved from the coupled-locked state (FIG. 17) to the coupled-unlocked state (FIGS. 15 and 16) by operating the lock cylinder 532 to transition the primary locking mechanism 530 to the primary unlocking state. The lock assembly 500 may then be moved to the transitional-uncoupled state (FIGS. 13 and 14) by pivoting the shackle 510 in the decoupling direction 592. As the shackle 510 pivots from the home position to the pivoted position, the spring 528 may urge the tube in the unlocking direction 554 to thereby transition the secondary locking mechanism 550 from the secondary locking state to the secondary unlocking state. When in the transitional-uncoupled state, the lock assembly 500 may be moved to the decoupled state (FIG. 12) by removing the distal foot 515 from the crossbar 520 to move the shackle 510 to the removed position.

If a person were to cut the shackle 510 in an attempt to defeat the lock assembly 500 when in the coupled-locked state, the proximal foot 514 would remain within the crossbar 520, thereby preventing the tube 540 from moving to the unlocking position. With the tube 540 retained in the locking position, the secondary locking mechanism 550 retains the distal foot 515 in the crossbar 520. As such, each of the feet 514, 515 remains securely engaged with the crossbar 520 in the event of a one-cut attack.

If the shackle 510 is cut, the distal leg 513 may be able to pivot through the pivotal range provided by the secondary locking mechanism 550. In other words, the distal leg 513 may be able to pivot in the decoupling direction 592 to the position which it occupies when the shackle 510 is in the pivoted position. As noted above, the relative dimensions of the tube 540 and grooves 517 may be selected such that when the distal foot 515 is keyed to the tube 540, pivoting of the shackle 510 is substantially limited to a predetermined pivotal range. The pivotal range corresponds to the angle through which the shackle 510 pivots when moving from the home position to the pivoted position. In certain embodiments, the pivotal range may be selected such that when the shackle 510 is in the pivoted position, the proximal foot 514 is positioned adjacent to the crossbar 520, but is not received in the tube 540. In the illustrated form, the relative dimensions of the tube 540 and grooves 517 are selected to provide a pivotal range which is greater than 10° but less than 20°. In other embodiments, the relative dimensions of the tube 540 and grooves 517 may, for example, be selected to provide a pivotal range between 10° and 30°, or between 14° and 18°.

The lock assembly 500 may be used to secure a portable object to a stationary object such as, for example, to prevent theft of the portable object. If an attacker were to cut the shackle 510, the distal leg 513 may be pivoted to enlarge the cut into a gap. By limiting the pivotal range of the distal leg 513, the maximum size of the gap may be reduced to a size at which neither of the objects can be passed through the gap. In such a case, the attacker must cut the shackle 510 a second time in order to decouple the portable object from the stationary object.

In addition to the states described above, the lock assembly 500 may be operable in a transitional-locked state which includes the pivoted position and the secondary locking state. For example, as the lock assembly 500 transitions from the coupled-unlocked state to the transitional-uncoupled state, the user may manually retain the tube 540 in the locking position against the biasing force of the spring 528. In other forms, the tube 540 may be manually moved from the locking position to the unlocking position. In such a transitional-coupled state, the secondary locking mechanism 550 prevents removal of the distal foot 515 from the crossbar 520, and may substantially limit or prevent pivoting of the shackle 510 in the decoupling direction 592.

With specific reference to FIGS. 18-27, a lock assembly 600 according to another embodiment includes a shackle 610 and a crossbar 620. The shackle 610 is configured substantially similar to the shackle 410 and includes a straight proximal foot 614 having a transverse groove 616, and an angled distal foot 615 having a pair of longitudinal grooves 617. The longitudinal grooves 617 define a narrowed section 619 of the distal foot 615. The crossbar 620 includes a primary locking mechanism 630 operable to engage the proximal foot 614, and a secondary locking mechanism 650 operable to engage the distal foot 615.

As described in further detail below, the shackle 610 is operable in a plurality of operational positions, including a removed position, a pivoted position, and a home position. In the removed position (FIGS. 19 and 20), neither the proximal foot 614 nor the distal foot 615 is received in the crossbar 620. In the pivoted position (FIGS. 23 and 24), the distal foot 615 is received in the crossbar 620 and the proximal foot 614 is not received in the crossbar 620. In the home position (FIGS. 25-27), each of the feet 614, 615 is received in the crossbar 620. Additionally, the lock assembly 600 is operable in a plurality of states, including a decoupled state (FIGS. 19 and 20), a transitional-uncoupled state (FIGS. 21 and 22), a transitional-coupled state (FIGS. 23 and 24), a coupled-unlocked state (FIGS. 25 and 26), and a coupled-locked state (FIG. 27).

The crossbar 620 includes a first tube or base pipe in the form of a tube 640, and also includes a housing 624 seated in the tube 640. The tube 640 includes a proximal opening 644 sized and shaped to receive the proximal foot 614, and a distal opening 645 sized and shaped to receive the distal foot 615. The tube openings 644, 645 are longitudinally spaced from one another by a distance corresponding to the longitudinal distance between the feet 614, 615. As a result, the tube openings 644, 645 are operable to concurrently receive the proximal foot 614 and the distal foot 615.

The crossbar 620 also includes the secondary locking mechanism 650 which generally includes a second tube or locking pipe in the form of a sleeve 670. The sleeve 670 is slidably mounted on the tube 640 and includes a proximal opening 674 sized and shaped to receive the proximal foot 614, and a distal opening 675 sized and shaped to receive the distal foot 615. The sleeve openings 674, 675 are longitudinally offset from one another by a different distance than the longitudinal distance between the feet 614, 615. As a result, the sleeve openings 674, 675 are not operable to concurrently receive the proximal and distal feet 614, 615.

The sleeve 670 also includes a locking slot 679 sized and shaped to receive the narrowed section 619 of the distal foot 615. The locking slot 679 extends distally from the distal opening 675 such that the proximal foot 614 can be positioned in the proximal sleeve opening 674 when the distal foot narrowed section 619 is positioned in the locking slot 679. In other words, the proximal sleeve opening 674 and the locking slot 679 are positioned and configured to concurrently receive the proximal foot 614 and the narrowed section 619 of the distal foot 615, respectively. Additionally, the radial thickness of the sleeve 670 is slightly less than a lateral dimension of the grooves 617. Thus, when the narrowed section 619 is received in the locking slot 679, pivoting of the distal foot 615 is limited, but is not prevented. As a result, the shackle 610 remains free to pivot between the home and pivoted positions when the distal foot 615 is keyed to the sleeve 670.

The relative dimensions of the sleeve 670 and the grooves 617 may be selected such that pivoting of the shackle 610 about a transverse axis 606 is limited to a predetermined pivotal range. The pivotal range may correspond to the angle through which the shackle 610 pivots when moving between the home position and the pivoted position. In such forms, the shackle 610 may be prevented from pivoting beyond the pivoted position in the decoupling direction 692 when the distal foot 615 is keyed to the tube 640. In certain embodiments, the pivotal range may be selected such that when the shackle 610 is in the pivoted position, the proximal foot 614 is positioned adjacent to the crossbar 620, but is not received in the sleeve 670.

The crossbar 620 may also include a sleeve cover 660 mounted on a distal end of the sleeve 670. The illustrated sleeve cover 660 includes an opening 665 generally aligned with the distal sleeve opening 675, and a slot 669 generally aligned with the locking slot 679. In the interest of clearly depicting the various states of the lock assembly 600, the sleeve cover 660 is not shown in FIGS. 21-26.

The locking pipe or sleeve 670 is longitudinally movable between an unlocking position and a locking position. In the unlocking position (FIGS. 19 and 20), the distal sleeve opening 675 is generally aligned with the distal tube opening 645, and the proximal tube opening 644 is longitudinally offset from the proximal sleeve opening 674. In the locking position (FIGS. 23-27), the proximal tube opening 644 is generally aligned with the proximal sleeve opening 674, and at least a portion of the locking slot 679 is generally aligned with the distal tube opening 645. The sleeve 670 is movable between the locking position and the unlocking position along a longitudinal locking path defining a locking direction 652 and an opposite unlocking direction 654. More specifically, the sleeve 670 is movable along the locking path in the locking direction 652 from the unlocking position to the locking position, and is movable along the locking path in the unlocking direction 654 from the locking position to the unlocking position.

The locking slot 679 extends from the distal opening 675 in the unlocking direction 654 such that the locking slot 679 becomes generally aligned with the distal tube opening 645 as the sleeve 670 moves toward the locking position. In the illustrated form, the proximal and distal sleeve openings 674, 675 are offset from one another by a lesser distance than the distance separating the proximal foot 614 and the distal foot 615. As a result, the locking slot 679 extends from the distal sleeve opening 675 in the distal direction such that the locking slot 679 is offset from the proximal sleeve opening by a distance corresponding to the distance separating the proximal foot 614 and the distal foot 615. Therefore, the unlocking direction 654 is the distal direction, and the locking direction 652 is the proximal direction. However, in other embodiments, the locking direction 652 and unlocking direction 654 may be reversed. For example, the proximal and distal sleeve openings 674, 675 may be offset from one another by a greater distance than the distance separating the proximal and distal feet 614, 615, and the locking slot 679 may extend from the distal sleeve opening 675 in the proximal direction. In other embodiments, the locking direction 652 and unlocking direction 654 need not be longitudinal directions, and may include rotational directions.

The sleeve 670 may include a guide slot 671, and a pin 621 may extend into the guide slot 671 from the tube 640. With the pin 621 received in the guide slot 671, the pin 621 substantially limits longitudinal movement of the sleeve 670 with respect to the tube 640, and rotationally couples the tube 640 and the sleeve 670. The pin 621 and the guide slot 671 may cooperate to limit the sleeve 670 to movement between the locking and unlocking positions and along the locking path.

Figure 19:
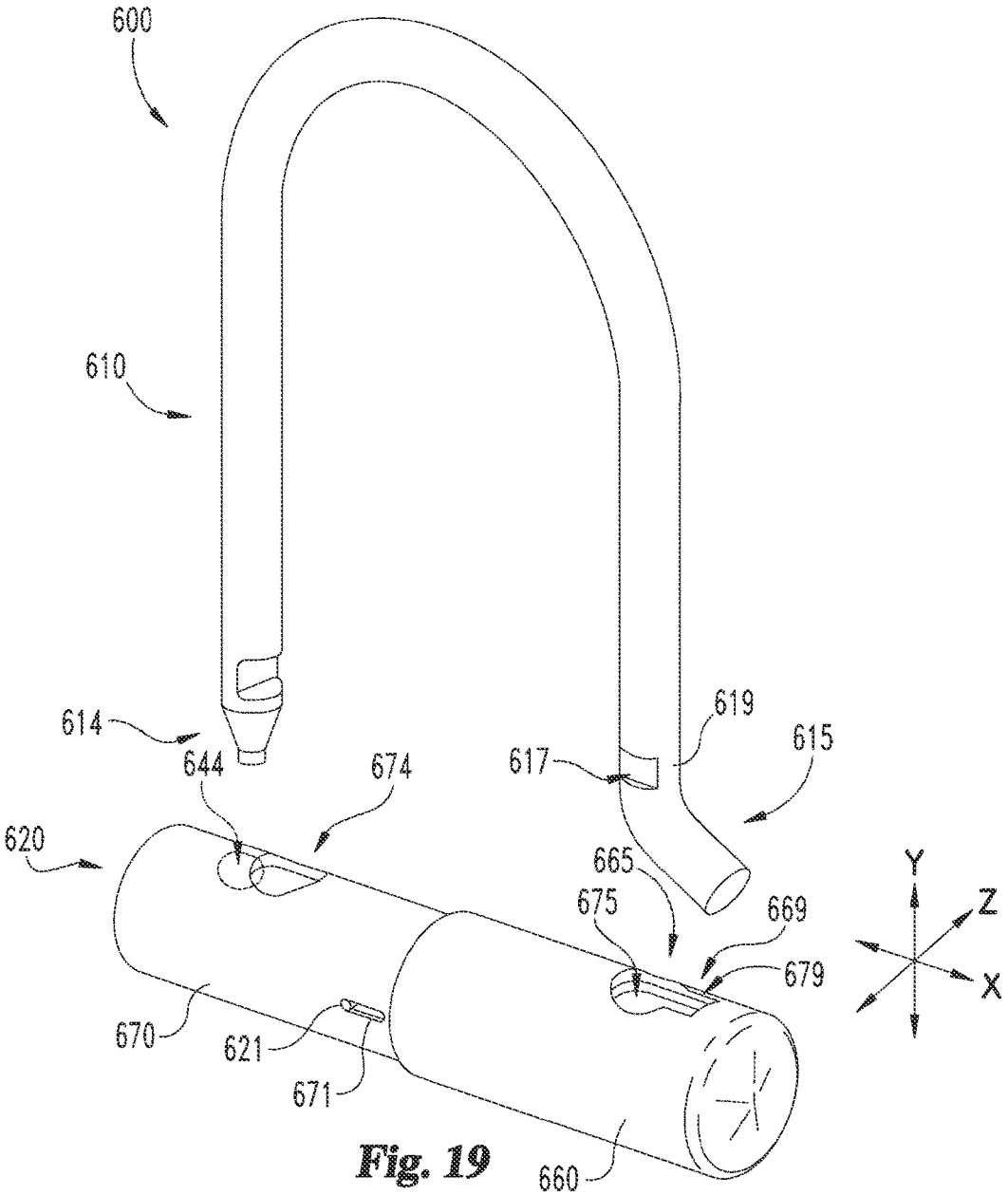
FIGS. 19 and 20 depict the lock assembly illustrated in FIG. 18 in a decoupled state.
Figure 20:
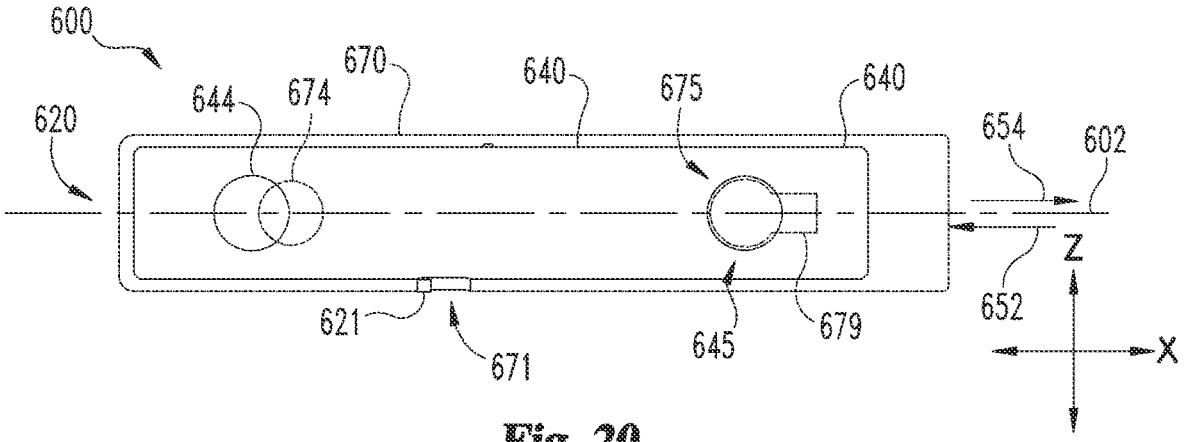

FIGS. 19 and 20 illustrate the lock assembly 600 in the decoupled state in which the shackle 610 is in the removed position, and is not coupled to the crossbar 620. Additionally, the sleeve 670 is in the unlocking position, thereby defining the unlocking state of the secondary locking mechanism 650. With the secondary locking mechanism 650 in the unlocking state, the distal sleeve opening 675 and the sleeve cover opening 665 are generally aligned with the distal tube opening 645. Additionally, with the sleeve 670 in the unlocking position, the proximal sleeve opening 674 is at least partially misaligned with the proximal tube opening 644. As such, when the secondary locking mechanism 650 is in the unlocking state, the distal foot 615 can be inserted into the crossbar 620, but the proximal foot 614 cannot.

Figure 21:
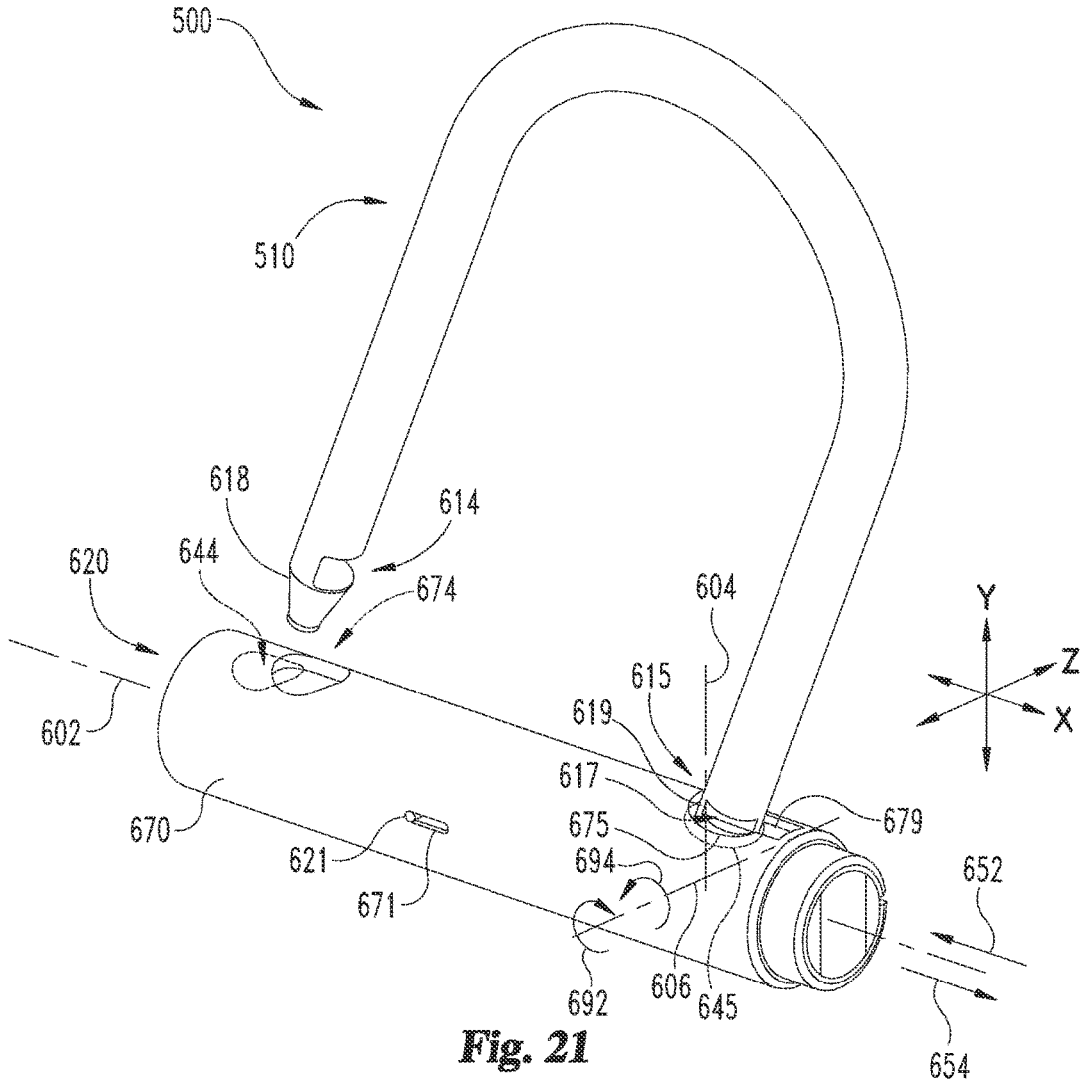
FIGS. 21 and 22 depict the lock assembly illustrated in FIG. 18 in a transitional-uncoupled state.
Figure 22:
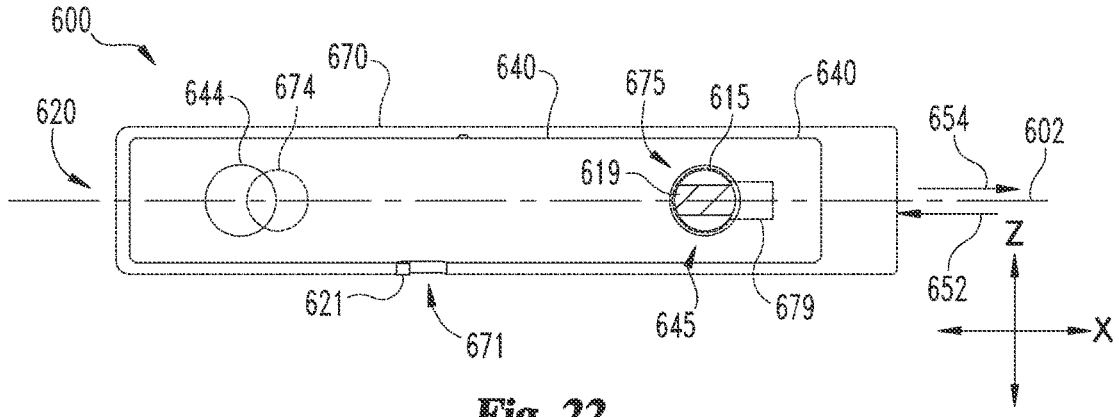

FIGS. 21 and 22 illustrate the lock assembly 600 in the transitional-uncoupled state in which the distal foot 615 has been inserted into the crossbar 620 through the distal openings 645, 675 such that the shackle 610 is in the pivoted position. Additionally, the locking pipe or sleeve 670 is in the unlocking position, thereby defining the unlocking state of the secondary locking mechanism 650. Thus, the transitional-uncoupled state includes the pivoted shackle position and the secondary unlocking state, and may further include the primary unlocking state. In this state, the shackle 610 is pivotable toward the home position in the coupling direction 694, and is also pivotable in the decoupling direction 692 or away from the home position. With the secondary locking mechanism 650 in the unlocking state, the distal foot 615 can be removed from the crossbar 620.

When in the transitional-uncoupled state, the narrowed section 619 of the distal foot 615 is positioned at least partially in the distal sleeve opening 675, and a distal end thereof is generally aligned with the locking slot 679. The lock assembly 600 can be moved to the transitional-coupled state by moving the sleeve 670 in a locking direction 652 such that the narrowed section 619 enters the locking slot 679. In the illustrated form, the sleeve 670 is manually moved to the locking position after insertion of the distal foot 615 into the crossbar 620. In other forms, the sleeve 670 may be urged to the locking position as the tapered toe 618 enters the proximal sleeve opening 674 such as, for example, in a manner similar to that in which the tapered toe 518 urges the tube 540 toward the locking position in the lock assembly 500.

Figure 23:
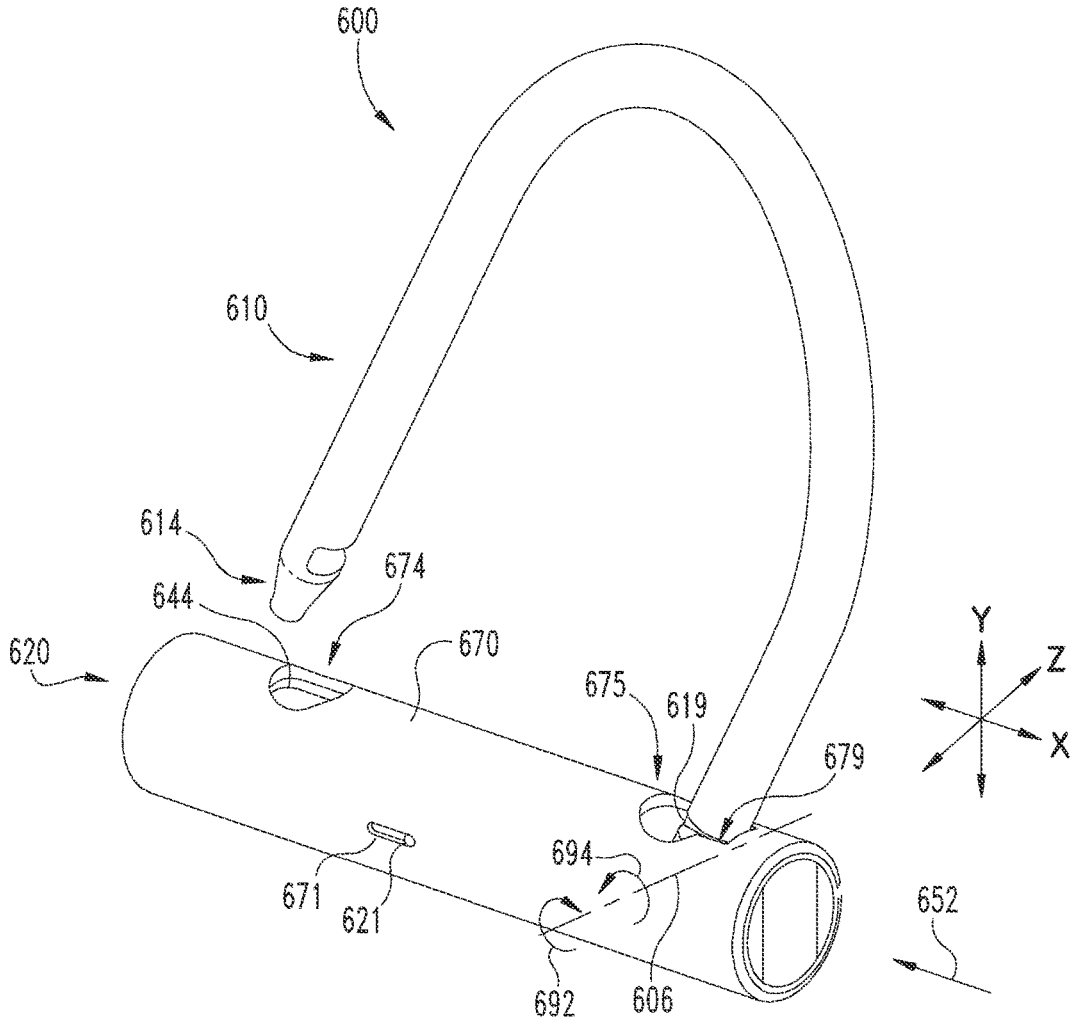
FIGS. 23 and 24 depict the lock assembly illustrated in FIG. 18 in a transitional-coupled state.
Figure 24:
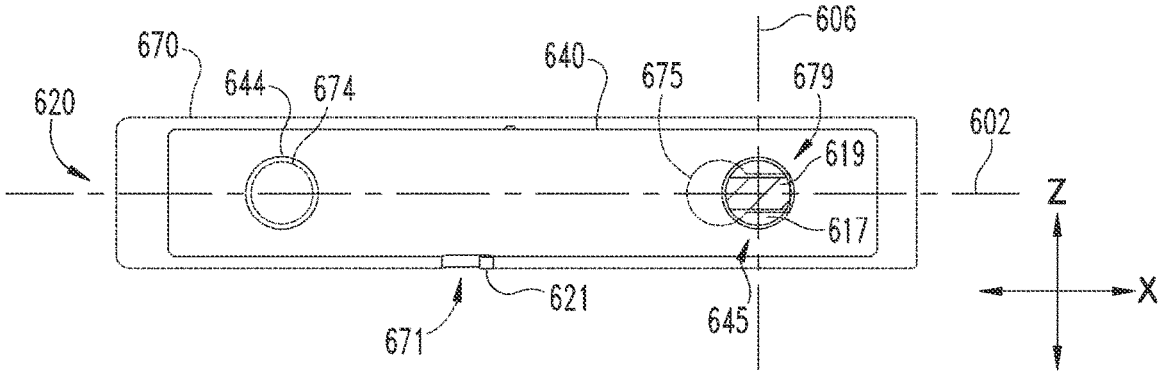

FIGS. 23 and 24 illustrate the lock assembly 600 in the transitional-coupled state in which the locking pipe or sleeve 670 has been moved to the locking position, thereby defining the locking state of the secondary locking mechanism 650. Thus, the transitional-coupled state includes the pivoted shackle position and the secondary locking state, and may further include the primary unlocking state. With the sleeve 670 in the locking position, the narrowed section 619 of the distal foot 615 is received in the locking slot 679 such that the distal foot 615 is keyed to the sleeve 670. As a result, pivoting of the shackle 610 in the decoupling direction 692 is substantially prevented by engagement between the edges of the locking slot 679 and the walls defining the longitudinal grooves 617. Additionally, the proximal sleeve opening 674 is generally aligned with the proximal tube opening 644, and the proximal foot 614 is arranged coplanar with the proximal openings 644, 674 on the X-Y plane.

In the transitional-coupled state, the lock assembly 600 can be moved to the coupled-unlocked state by pivoting the shackle 610 along the X-Y plane toward the home position. As the shackle 610 pivots about the transverse axis 606 in the coupling direction 694, the proximal foot 614 enters the crossbar 620 through the openings 644, 674. When the shackle 610 reaches the home position, the lock assembly 600 is in the coupled-unlocked state.

Figure 25:
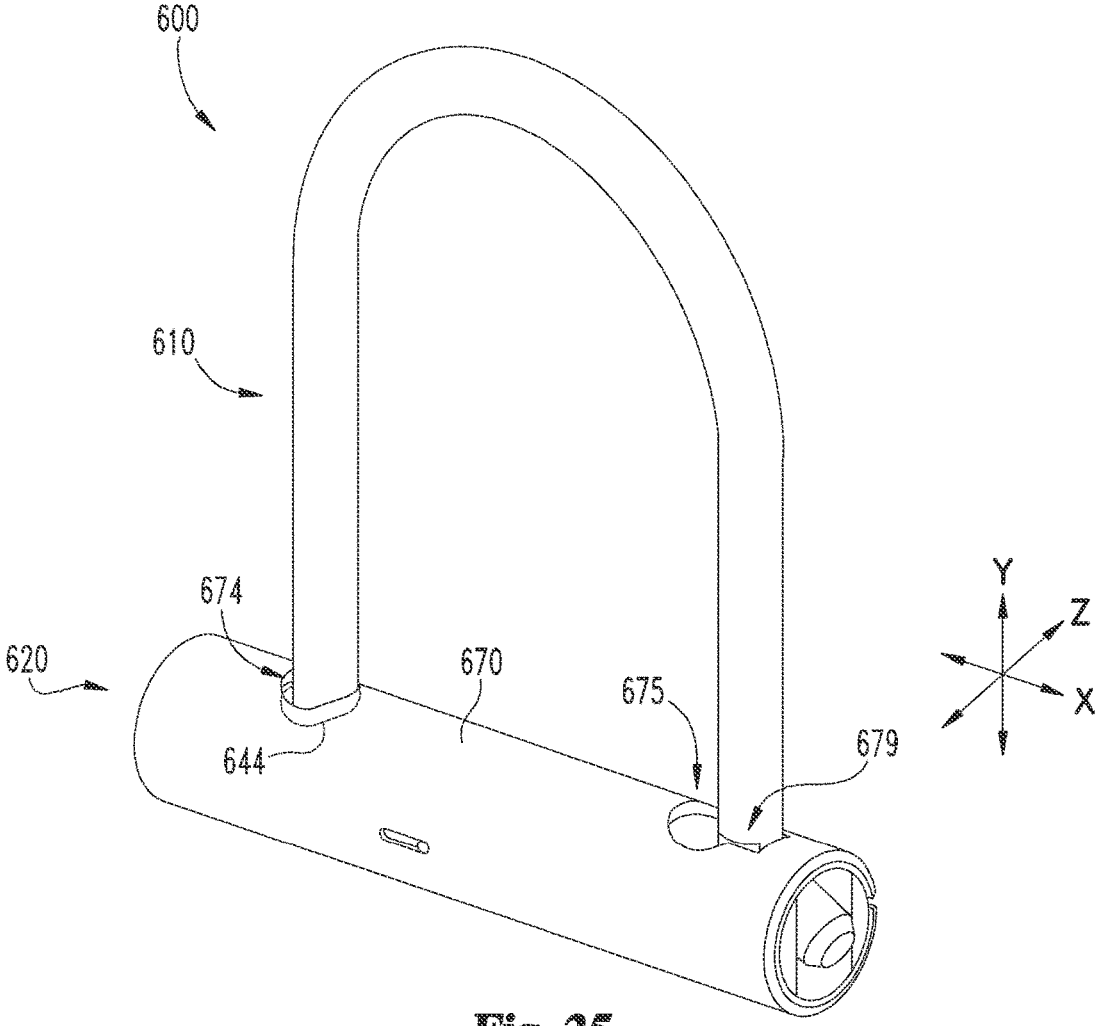
FIGS. 25 and 26 depict the lock assembly illustrated in FIG. 18 in a coupled-unlocked state.
Figure 26:
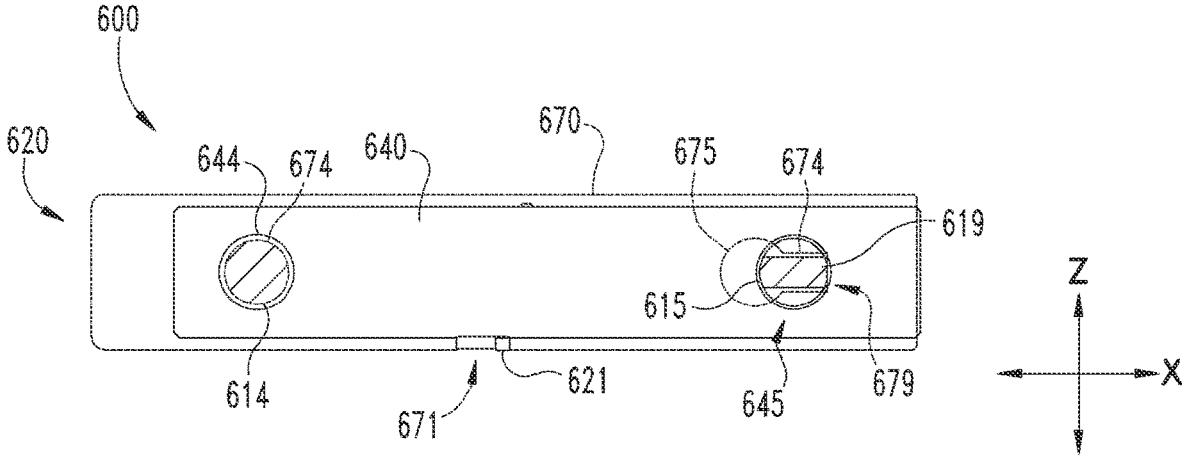
Figure 27:
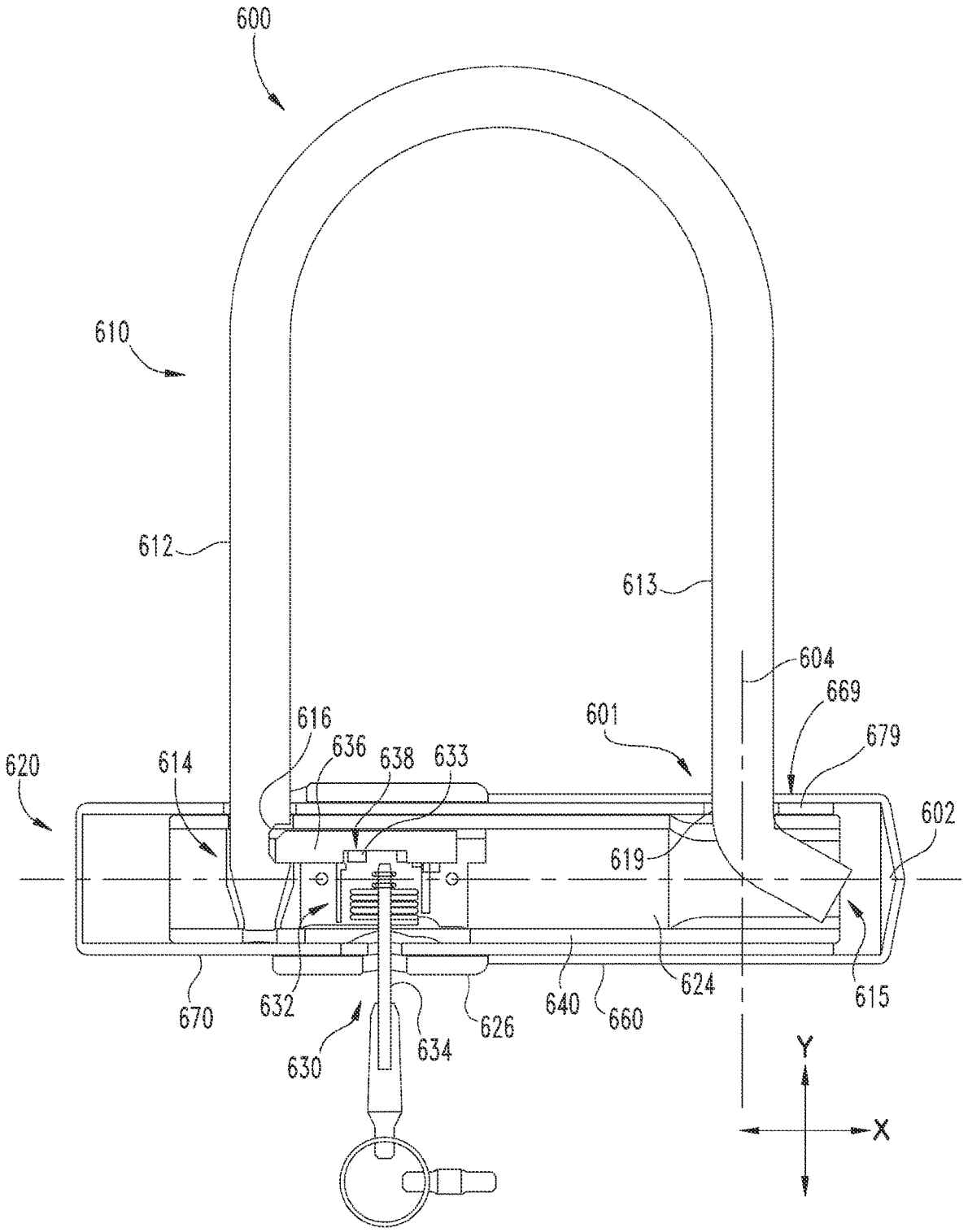
FIG. 27 is a side sectional view of the lock assembly illustrated in FIG. 18 in a coupled-locked state.
Figure 28:
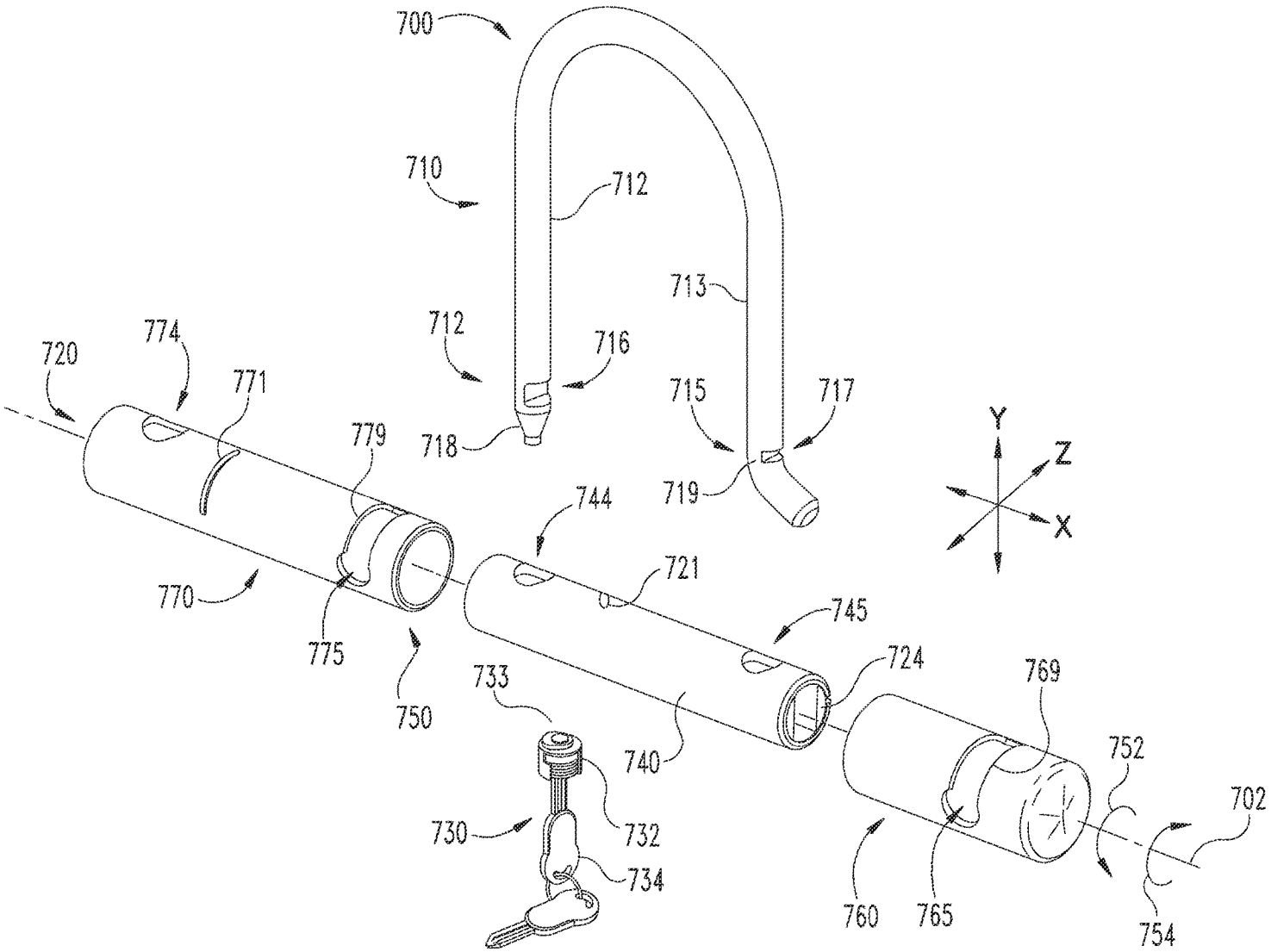
FIG. 28 is an exploded assembly illustration of a lock assembly according to another embodiment.

FIGS. 25 and 26 illustrate the lock assembly 600 in the coupled-unlocked state in which each of the feet 614, 615 is received in the crossbar 620, and the sleeve 670 is in the locking position. Additionally, the primary locking mechanism 630 is in the unlocking state such that removal of the proximal foot 614 from the crossbar 620 is not prevented. In other words, the coupled-unlocked state includes the pivoted shackle position, the primary unlocking state, and the secondary locking state. In this state, the primary locking mechanism 630 does not prevent removal of the proximal foot 614 from the crossbar 620, and the secondary locking mechanism 650 prevents removal of the distal foot 615 from the crossbar 620.

With the proximal foot 614 extending through the openings 644, 674, the sleeve 670 is unable to move to the unlocking position. As such, the distal foot 615 cannot be removed from the crossbar 620 without first pivoting the shackle 610 in the decoupling direction 692 to remove the proximal foot 614 from the crossbar 620, and subsequently moving the sleeve 670 to the unlocking position. When in the coupled-unlocked state, the lock assembly 600 can be moved to the coupled-locked state by operating the lock cylinder 632 to move the primary locking mechanism 630 to the primary locking state.

FIG. 27 illustrates the lock assembly 600 in the coupled-locked state in which each of the primary locking mechanism 630 and secondary locking mechanism 650 is in the locking state. Thus, the coupled-locked state includes the home shackle position, the primary locking state, and the secondary locking state. In this state, the deadbolt 636 is engaged with the proximal foot 614 and prevents removal of the proximal foot 614 from the crossbar 620. Additionally, the secondary locking mechanism 650 is engaged with the distal foot 615 and prevents removal of the distal foot 615 from the crossbar 620. As such, the shackle 610 is securely coupled to the crossbar 620.

As will be appreciated, the lock assembly 600 may be moved from the coupled-locked state (FIG. 27) to the coupled-unlocked state (FIG. 25) by operating the lock cylinder 632 to transition the primary locking mechanism 630 to the primary unlocking state. The lock assembly 600 may then be moved to the transitional-coupled state (FIG. 23) by pivoting the shackle 610 in the decoupling direction 692 from the home position to the pivoted position. The lock assembly 600 may then be moved to the transitional-uncoupled state (FIG. 21) by moving the sleeve 670 in the unlocking direction 654 to transition the secondary locking mechanism 650 from the secondary locking state to the secondary unlocking state. When in the transitional-uncoupled state, the lock assembly 600 may be moved to the decoupled state (FIG. 19) by removing the distal foot 615 from the crossbar 620 to move the shackle 610 to the removed position.

If a person were to cut the shackle 610 in an attempt to defeat the lock assembly 600 when in the coupled-locked state, the primary locking mechanism 630 would retain the proximal foot 614 within the crossbar 620, thereby preventing the sleeve 670 from moving to the unlocking position. As noted above, the distal foot 615 can only be removed from the crossbar 620 when the sleeve 670 has been moved to the unlocking position. As such, each of the feet 614, 615 remains securely engaged with the crossbar 620 in the event of a one-cut attack. Additionally, with pivoting of the distal leg 613 is limited by the secondary locking mechanism 650, the attacker may be unable to enlarge the gap to a size at which the lock assembly 600 can be defeated. In such a case, the attacker must make a second cut to remove a portion of the shackle 610 in order to defeat the lock assembly 600.

With specific reference to FIGS. 28-33, a lock assembly 700 according to another embodiment includes a shackle 710 and a crossbar 720 including a primary locking mechanism 730 and a secondary locking mechanism 750. The shackle 710 includes a straight proximal foot 714 having a transverse groove 716, and an angled distal foot 715 having a pair of transverse grooves 717. The transverse grooves 717 define a narrowed section 719 of the distal foot 715. The primary locking mechanism 730 is operable to engage the proximal foot 714, and the secondary locking mechanism 750 is operable to engage the distal foot 715.

As described in further detail below, the shackle 710 is operable in a plurality of positions, including a removed position, a pivoted position, and a home position. In the removed position (FIG. 29), neither the proximal foot 714 nor the distal foot 715 is received in the crossbar 720. In the pivoted position (FIGS. 30 and 31), the distal foot 715 is received in the crossbar 720, and the proximal foot 714 is not received in the crossbar 720. In the home position (FIGS. 32 and 33), each of the feet 714, 715 is received in the crossbar 720. Additionally, the lock assembly 700 is operable in a plurality of states, including a decoupled state (FIG. 29), a transitional-uncoupled state (FIG. 30), a transitional-coupled state (FIG. 31), a coupled-unlocked state (FIG. 32), and a coupled-locked state (FIG. 33).

The crossbar 720 includes a first tube or base pipe in the form of a tube 740. The tube 740 includes a proximal opening 744 sized and shaped to receive the proximal foot 714, and a distal opening 745 sized and shaped to receive the distal foot 715. The tube openings 744, 745 are longitudinally spaced from one another by a distance corresponding to the longitudinal distance between the feet 714, 715, and are angularly aligned with one another. As a result, the tube openings 744, 745 are operable to concurrently receive the proximal foot 714 and the distal foot 715. In other words, the proximal foot 714 and the distal foot 715 can be concurrently positioned in the proximal tube opening 744 and the distal tube opening 745, respectively.

The crossbar 720 also includes the secondary locking mechanism 750 which generally includes a second tube or locking pipe in the form of a sleeve 770 which is rotatably mounted on the tube 740. The sleeve 770 includes a proximal opening 774 sized and shaped to receive the proximal foot 714, and a distal opening 775 sized and shaped to receive the distal foot 715. The sleeve openings 774, 775 are angularly offset from one another about the longitudinal axis 702. As a result, the sleeve openings 774, 775 are not operable to concurrently receive the proximal foot 714 and the distal foot 715. The sleeve 770 also includes a locking slot 779 which is sized and shaped to receive the narrowed section 719 of the distal foot 715. The locking slot 779 extends from the distal sleeve opening 775 about a portion of the periphery of the sleeve 770.

The locking pipe or sleeve 770 is rotatable between an unlocking position and a locking position. In the unlocking position (FIG. 29), the distal sleeve opening 775 is generally aligned with the distal tube opening 745, and the proximal tube opening 744 is angularly offset from the proximal sleeve opening 774. In the locking position (FIGS. 31-33), the proximal tube opening 744 is generally aligned with the proximal sleeve opening 774, and a portion of the peripheral locking slot 779 is generally aligned with the distal tube opening 745.

The locking pipe or sleeve 770 is movable between the locking position and the unlocking position along a rotational locking path defining a locking direction 752 and an opposite unlocking direction 754. More specifically, the sleeve 770 is movable along the locking path in the locking direction 752 from the unlocking position to the locking position, and is movable along the locking path in the unlocking direction 754 from the locking position to the unlocking position. The locking slot 779 extends from the distal opening 775 in the unlocking direction 754 such that the locking slot 779 becomes generally aligned with the distal tube opening 745 as the sleeve 770 rotates in the locking direction 752 from the unlocking position.

In the illustrated form, the tube openings 744, 745 are centered on the X-Y plane, and the sleeve openings 774, 775 are offset from one another by about 90° with respect to the longitudinal axis 702. As such, the sleeve 770 must be rotated along the locking path by a locking angle of 90° to transition the secondary locking mechanism 750 between the locking and unlocking states. In other embodiments, the sleeve openings 774, 775 may be offset from one another by a different locking angle, and the central angle of the arc defining the locking slot 779 may correspond to the locking angle.

The radial thickness of the sleeve 770 is slightly less than a lateral dimension of the grooves 717. Thus, when the narrowed section 719 is received in the locking slot 779, pivoting of the distal foot 715 is limited, but is not prevented. As a result, the shackle 710 remains free to pivot between the pivoted and home positions when the distal foot 715 is keyed to the sleeve 770. The relative dimensions of the sleeve 770 and grooves 717 may be selected such that pivoting of the shackle 710 is substantially limited to a predetermined pivotal range. The pivotal range may correspond to the angle through which the shackle 710 pivots when moving from the home position to the pivoted position. In certain embodiments, the pivotal range may be selected such that when the shackle 710 is in the pivoted position, the proximal foot 714 is positioned adjacent to the crossbar 720, but is not received in the sleeve 770.

The sleeve 770 may also include a guide slot 771 extending along a portion of the periphery of the sleeve 770 in the locking and unlocking directions 752, 754. A pin 721 is coupled to the tube 740 and extends into the guide slot 771. The pin 721 limits the rotational range of the sleeve 770 with respect to the tube 740, and substantially prevents relative longitudinal movement of the sleeve 770 and the tube 740. The pin 721 and the guide slot 771 may cooperate to limit movement of the sleeve 770 to the locking and unlocking directions 752, 754, or movement along the locking path.

The guide slot 771 is arranged substantially parallel to the locking slot 779. With the shackle 710 in the pivoted position, the pin 721 received in the guide slot 771, and the narrowed section 719 received in the locking slot 779, the sleeve 770 is substantially limited to movement along the locking path. As will be appreciated, the central angles of the arcs defining the guide slot 771 and the locking slot 779 correspond to the angular offset of the sleeve openings 774, 775, or the locking angle. In the illustrated form, the arcs defining the centerlines of the peripheral slots 771, 779 do not vary in the longitudinal direction, and are confined to planes parallel to the Y-Z plane. However, in other embodiments, the peripheral slots 771, 779 may be configured as helical slots which extend in the longitudinal direction.

The crossbar 720 may also include a sleeve cover 760 mounted on a distal end of the sleeve 770. The sleeve cover 760 includes an opening 765 generally aligned with the distal sleeve opening 775, and a peripheral slot 769 generally aligned with the locking slot 779.

Figure 29:
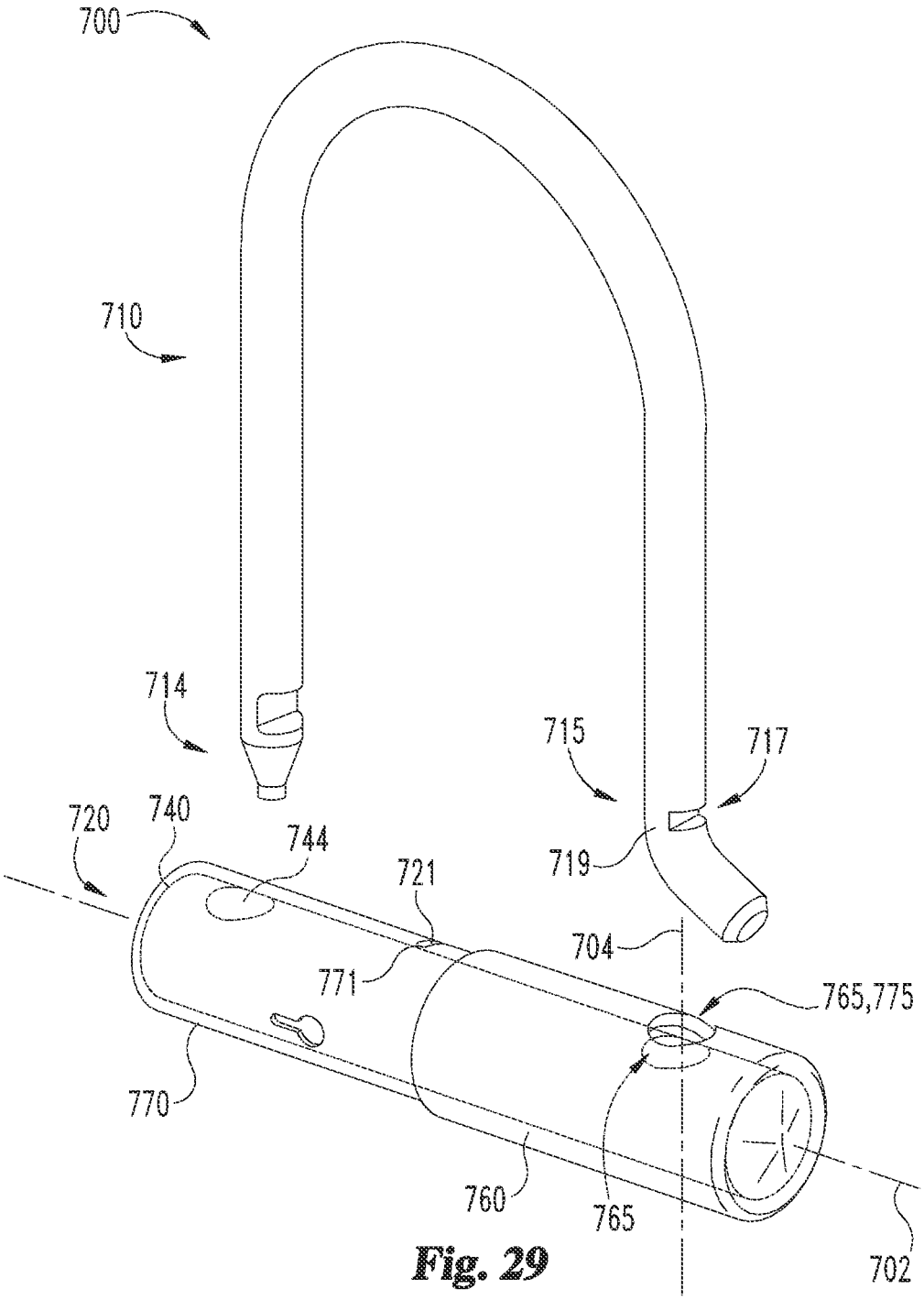
FIG. 29 depicts the lock assembly illustrated in FIG. 28 in a decoupled state.

FIG. 29 illustrates the lock assembly 700 in the decoupled state in which neither of the feet 714, 715 is received in the crossbar 720, thereby defining the removed shackle position. Additionally, the locking pipe or sleeve 770 is in the unlocking position, thereby defining the unlocking state of the secondary locking mechanism 750. With the sleeve 770 in the unlocking position, the distal sleeve opening 775 is generally aligned with the distal tube opening 745. As a result, the distal foot 715 can be freely inserted into and removed from the crossbar 720 through the distal openings 745, 775. When in the decoupled state, the lock assembly 700 can be moved to the transitional-uncoupled state by inserting the distal foot 715 into the crossbar 720 through the distal openings 745, 775.

Figure 30:
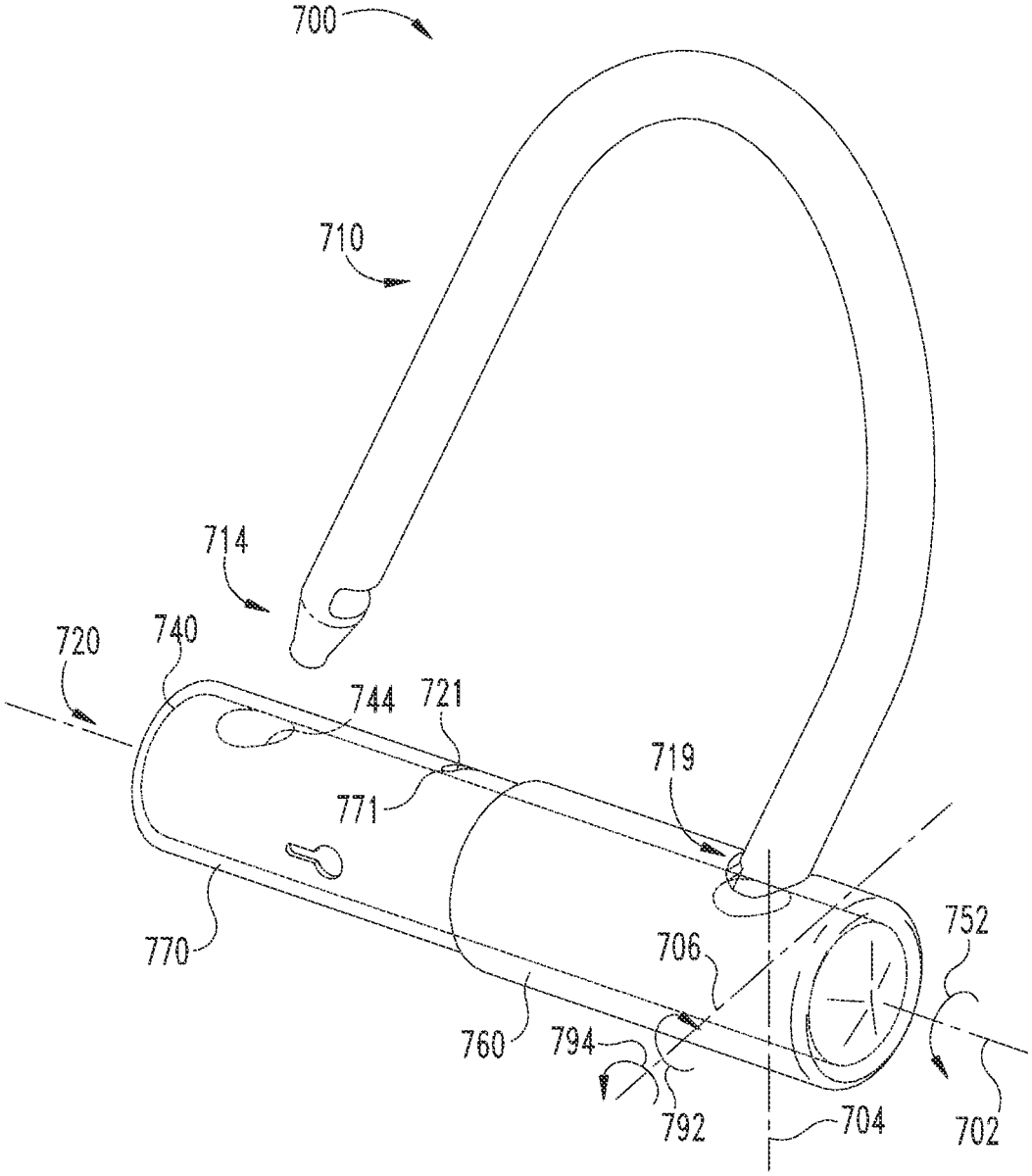
FIG. 30 depicts the lock assembly illustrated in FIG. 28 in a transitional-uncoupled state.

FIG. 30 illustrates the lock assembly 700 in the transitional-uncoupled state in which the distal foot 715 has been inserted into the crossbar 720 such that the shackle 710 is in the pivoted position. Additionally, the locking pipe or sleeve 770 is in the unlocking position, thereby defining the unlocking state of the secondary locking mechanism 750. Thus, the transitional-uncoupled state includes the pivoted shackle position and the secondary unlocking state, and may further include the primary unlocking state. In this state, the shackle 710 is pivotable along the X-Y plane in both the decoupling direction 792 and the coupling direction 794. In other words, the shackle 710 can be pivoted about a transverse axis 706 both toward the home position and away from the home position. Additionally, with the secondary locking mechanism 750 in the unlocking state, removal of the distal foot 715 from the crossbar 720 is enabled.

When in the transitional-uncoupled state, the narrowed section 719 of the distal foot 715 is positioned at least partially in the distal sleeve opening 775 and is generally aligned with the locking slot 779. The lock assembly 700 can be moved to the transitional-coupled state by rotating the sleeve 770 about the longitudinal axis 702 in the locking direction 752. As the sleeve 770 rotates toward the locking position, the narrowed section 719 enters the locking slot 779. When the sleeve 770 reaches the locking position, the secondary locking mechanism 750 is in the locking state and the lock assembly 700 is in the transitional-coupled state.

Figure 31:
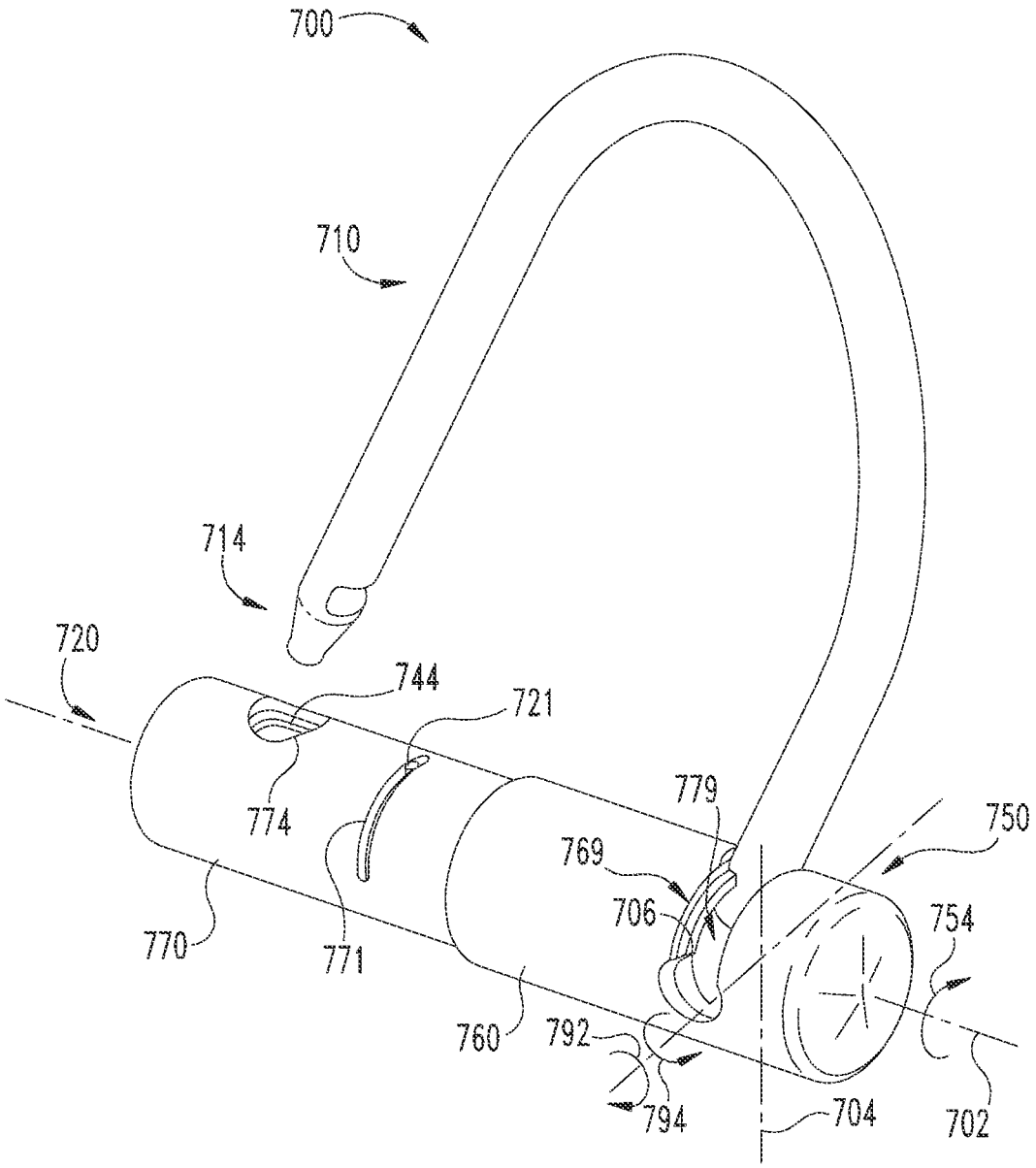
FIG. 31 depicts the lock assembly illustrated in FIG. 28 in a transitional-coupled state.

FIG. 31 illustrates the lock assembly 700 in the transitional-coupled state in which the locking pipe or sleeve 770 has been rotated to the locking position, thereby defining the locking state of the secondary locking mechanism 750. Thus, the transitional-coupled state includes the pivoted shackle position and the secondary locking state, and may further include the primary unlocking state. With the sleeve 770 in the locking position, the narrowed section 719 of the distal foot 715 is received in the locking slot 779 such that the distal foot 715 is keyed to the sleeve 770. As a result, pivoting of the shackle 710 in the decoupling direction 792 is prevented by engagement between the edges of the locking slot 779 and the walls defining the transverse grooves 717. Additionally, the proximal sleeve opening 774 is generally aligned with the proximal tube opening 744, and the proximal foot 714 is arranged coplanar with the proximal openings 744, 774 on the X-Y plane. The lock assembly 700 can be thus moved to the coupled-unlocked state by pivoting the shackle 710 about the transverse axis 706 toward the home position, or in the coupling direction 794. As the shackle 710 pivots in the coupling direction 794, the proximal foot 714 enters the crossbar 720 through the proximal openings 744, 774. When the shackle 710 reaches the home position, the lock assembly 700 is in the coupled-unlocked state.

Figure 32:
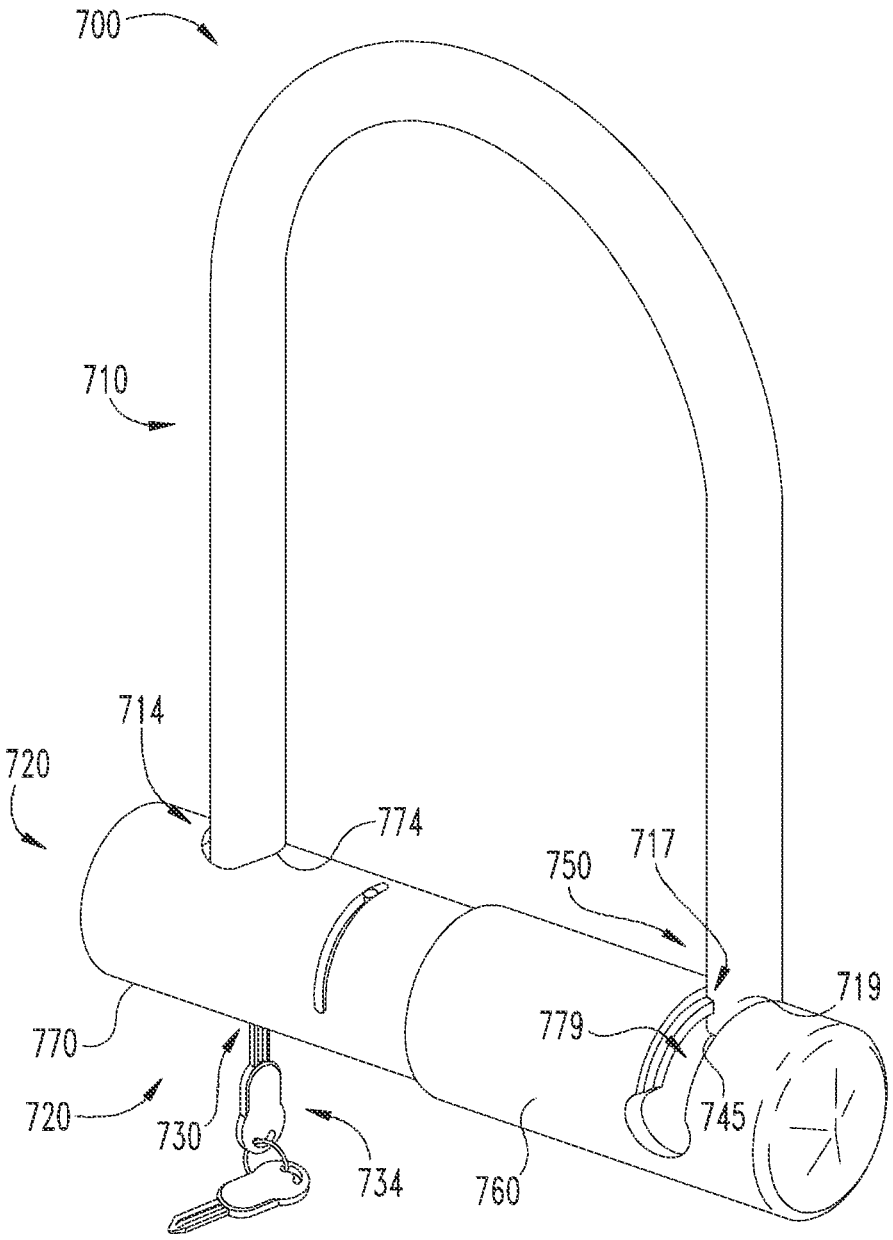
FIG. 32 depicts the lock assembly illustrated in FIG. 28 in a coupled-unlocked state.
Figure 33:
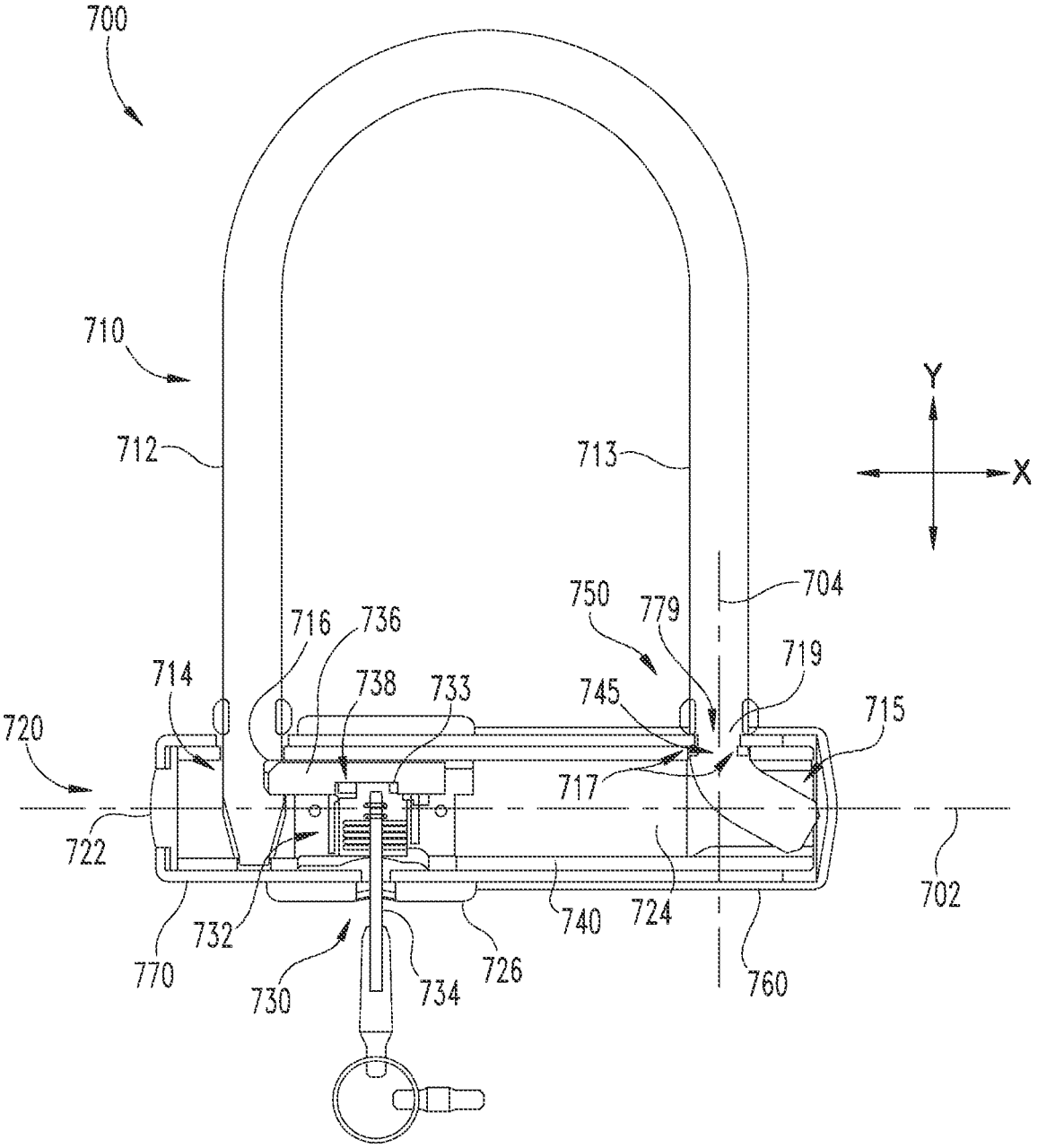
FIG. 33 is a side-sectional view of the lock assembly illustrated in FIG. 28 in a coupled-locked state.

FIG. 32 illustrates the lock assembly 700 in the coupled-unlocked state in which each of the feet 714, 715 is received in the crossbar 720 and the locking sleeve 770 is in the locking position. Additionally, the primary locking mechanism 730 is in the unlocking state such that removal of the proximal foot 714 from the crossbar 720 is not prevented. In other words, the coupled-unlocked state includes the home shackle position, the primary unlocking state, and the secondary locking state. In this state, the primary locking mechanism 730 does not prevent removal of the proximal foot 714 from the crossbar 720, and the secondary locking mechanism 750 prevents removal of the distal foot 715 from the crossbar 720. With the proximal foot 714 extending through the openings 744, 774, the sleeve 770 is unable to rotate to the unlocking position. As such, the distal foot 715 cannot be removed from the crossbar 720 without first pivoting the shackle 710 in the decoupling direction 792 to remove the proximal foot 714 from the crossbar 720, and subsequently rotating the sleeve 770 in the unlocking direction 754. When in the coupled-unlocked state, the lock assembly 700 can be moved to the coupled-locked state by operating the lock cylinder 732 to move the primary locking mechanism 730 to the primary locking state.

FIG. 33 illustrates the lock assembly 700 in the coupled-locked state in which each of the locking mechanisms 730, 750 is in the locking state thereof. Thus, the coupled-locked state includes the home shackle position, the primary locking state, and the secondary locking state. In this state, the deadbolt 736 is engaged with the proximal foot 714 and prevents removal of the proximal foot 714 from the crossbar 720. Additionally, the secondary locking mechanism 750 is engaged with the distal foot 715 and prevents removal of the distal foot 715 from the crossbar 720. As such, the shackle 710 is securely coupled to the crossbar 720.

As should be appreciated, the lock assembly 700 may be moved from the coupled-locked state (FIG. 33) to the coupled-unlocked state (FIG. 32) by operating the lock cylinder 732 to transition the primary locking mechanism 730 to the primary unlocking state. The lock assembly 700 may then be moved to the transitional-coupled state (FIG. 31) by pivoting the shackle 710 in the decoupling direction 792 from the home position to the pivoted position. The lock assembly 700 may then be moved to the transitional-uncoupled state (FIG. 30) by rotating the sleeve 770 in the unlocking direction 754 to transition the secondary locking mechanism 750 from the secondary locking state to the secondary unlocking state. When in the transitional-uncoupled state, the lock assembly 700 may be moved to the decoupled state (FIG. 29) by removing the distal foot 715 from the crossbar 720 to move the shackle 710 to the removed position.

If a person were to cut the shackle 710 in an attempt to defeat the lock assembly 700 when in the coupled-locked state, the proximal foot 714 would remain within the crossbar 720, thereby preventing the sleeve 770 from moving to the unlocking position. As noted above, the distal foot 715 can only be removed from the crossbar 720 when the sleeve 770 has been rotated the unlocking position. As such, each of the feet 714, 715 remains securely engaged with the crossbar 720 in the event of a one-cut attack. Additionally, with pivoting of the distal leg 713 limited by the secondary locking mechanism 750, the attacker may be unable to enlarge the gap to a size at which the lock assembly 700 can be defeated. In such a case, the attacker must make a second cut to remove a portion of the shackle 710 in order to defeat the lock assembly 700.

Figure 34:
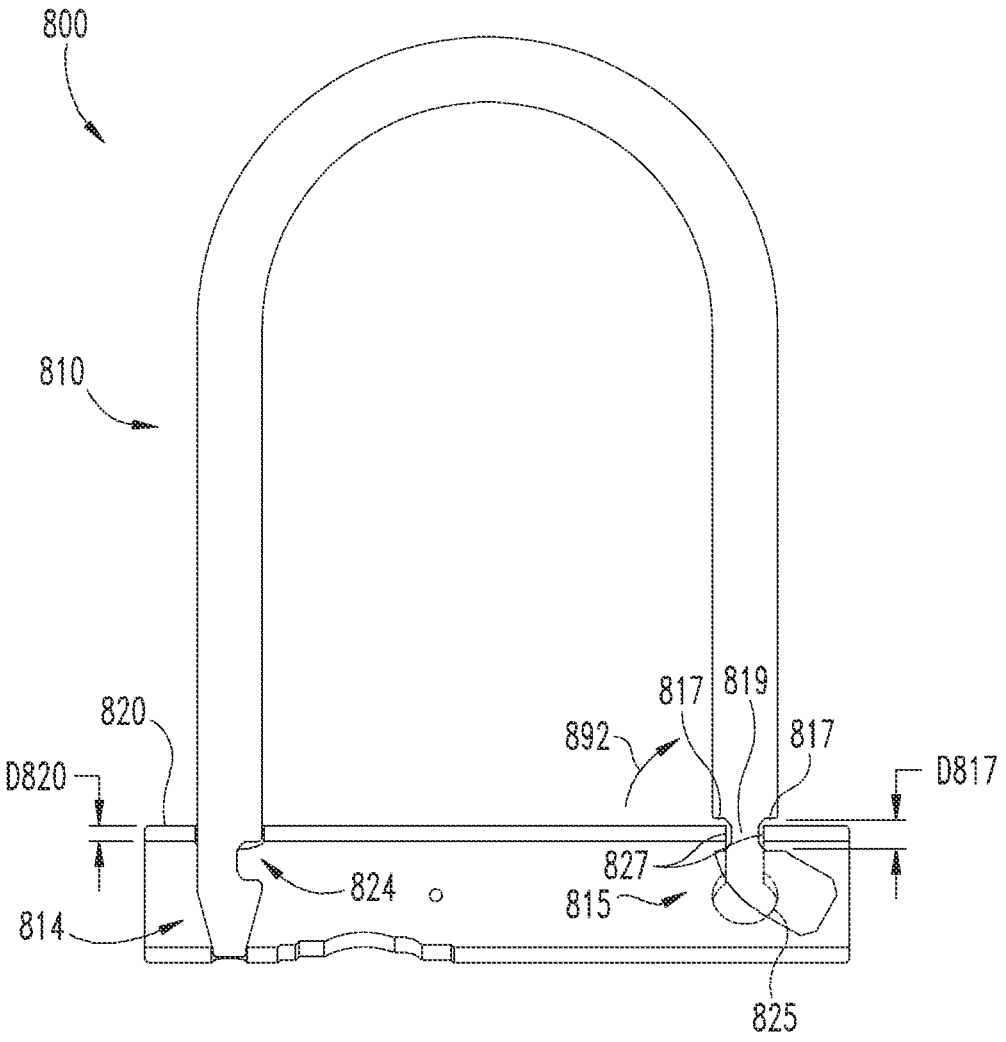
FIG. 34 is a cross-sectional illustration of a portion of a lock assembly including a shackle.
Figure 35:
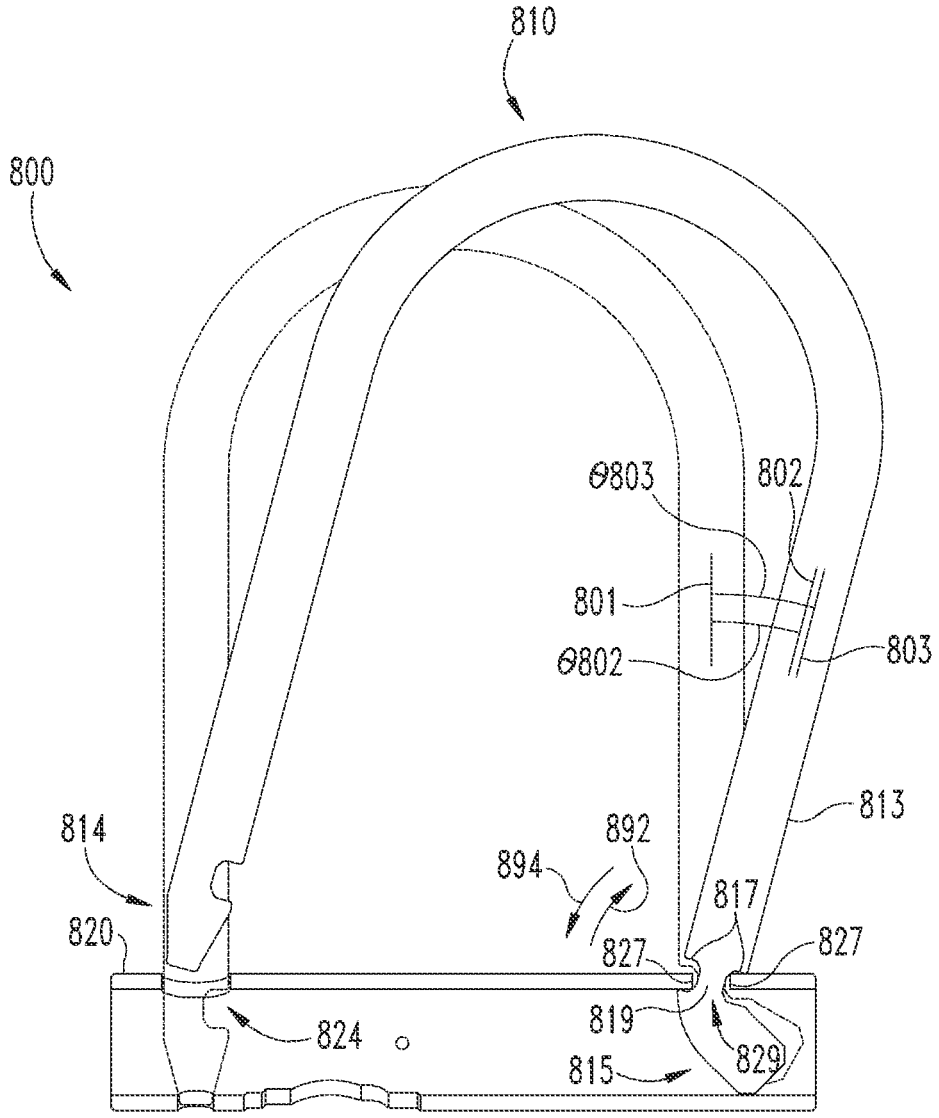
FIG. 35 illustrates exemplary positions of the shackle of the lock assembly depicted in FIG. 34.

Referring to FIGS. 34 and 35, shown therein are schematic representations of a portion of a lock assembly 800 including a shackle 810 and a locking pipe 820. The shackle 810 includes a straight proximal foot 814 and an angled distal foot 815. The angled distal foot 815 includes a pair of grooves 817 which define a narrowed section 819 of the distal foot 815. The locking pipe 820 includes a proximal opening 824 sized and shaped to receive the proximal foot 814, a distal opening 825 sized and shaped to receive the distal foot 815, and a locking slot 829 sized and shaped to receive the narrowed section 819 of the distal foot 815. The locking slot 829 is defined in part by a pair of edges 827, and extends from the distal opening 825 in an unlocking direction.

FIG. 34 illustrates the shackle 810 in a home shackle position in which each of the feet 814, 815 is received in the locking pipe 820. Additionally, the locking pipe 820 is in a locking position in which the narrowed section 819 is received in the locking slot 829. As will be appreciated, this configuration may correspond to a coupled-unlocked state of the lock assembly 800 in which the shackle 810 is pivotable in a decoupling direction 892 toward a pivoted shackle position.

As illustrated in FIG. 34, the locking pipe 820 has a thickness or radial dimension D820 which is slightly less than a lateral dimension D817 of the grooves 817. As with the embodiments described above, the relative dimensions of the locking pipe 820 and the grooves 817 defining the narrowed section 819 may be selected to limit the pivotal range of the shackle 810 when the distal foot 815 is keyed to the locking pipe 820. As described below, the dimensions D817, D820 of the grooves 817 and the locking pipe 820 are selected to limit the shackle 810 to pivoting through a predetermined pivotal range θ.

With additional reference to FIG. 35, the shackle 810 is operable in a home position, a threshold pivoted position, and a terminal pivoted position. In the interest of clarity, the positions are represented schematically by elements 801, 802 and 803, which respectively illustrate the orientation of the distal leg 813 in each of these positions. When in the home position 801, the shackle 810 is pivotable in the decoupling direction 892 to the threshold pivoted position 802 in which the proximal foot 814 is positioned adjacent to the proximal opening 824, but is not received therein. In other words, the threshold pivoted position 802 is the position in which pivoting the shackle 810 in the coupling direction 894 will cause the proximal foot 814 to enter the proximal opening 824.

The threshold pivoted position 802 is offset from the home position 801 by a threshold pivot angle θ802. When in the threshold pivoted position 802, the shackle 810 may be pivotable in the decoupling direction 892 to a terminal pivoted position 803 which is offset from the home position 801 by a terminal pivot angle θ803. In the terminal pivoted position 803, the locking pipe 820 prevents further pivoting of the shackle 810 in the decoupling direction 892. In other words, the locking pipe 820 limits pivoting of the shackle 810 to a pivotal range θ which corresponds to the terminal pivot angle θ803.

In the illustrated form, terminal pivoted position 803 is substantially the same as the threshold pivoted position 802. As such, the locking pipe 820 limits pivoting of the shackle 810 to a pivotal range θ corresponding to the terminal pivot angle θ803 which is substantially equal to the threshold pivot angle θ802. In other embodiments, the terminal pivot angle θ803 may be slightly greater than the threshold pivot angle θ802. In such embodiments, the shackle 810 in the threshold pivoted position 802 may be pivotable in the decoupling direction 892 by an angle corresponding to the difference between the threshold and terminal pivot angles θ802, θ803.

In the illustrated form, the threshold pivot angle θ802 is about 14°, and the dimensions D817, D820 are selected to limit pivoting of the shackle 810 to a pivotal range θ of about 15°. In other words, the terminal pivot angle θ803 is about 1° greater than the threshold pivot angle θ802. In other embodiments, the threshold pivot angle θ802 may be between 12° and 18°, or between 10° and 20°. Additionally, the dimensions D817, D820 may be selected such that the terminal pivot angle θ803 is greater than the threshold pivot angle θ802 by 0° to 5°. In certain embodiments, the dimensions D817, D820 may be selected such that the terminal pivot angle θ803 is greater than the threshold pivot angle θ802 by 1° to 3°.

While the lock assembly 800 is illustrated as including only the shackle 810 and the locking pipe 820, it should be appreciated that the foregoing descriptions may be applied to one or more of the above-described lock assemblies. For example, the lock assembly 700 described with reference to FIGS. 28-33 includes a shackle 710 and a locking pipe in the form of a sleeve 770 which may be configured in a manner similar to the shackle 810 and locking pipe 820 describe with reference to FIGS. 34 and 35. Furthermore, while the illustrated shackle 810 includes transverse grooves 817 and the locking pipe 820 includes a peripheral locking slot 829, those having ordinary skill in the art would be readily able to apply the foregoing to lock assemblies having shackles and locking tubes of other configurations such as, for example, the above-described lock assemblies 500, 600.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A lock assembly having a longitudinal axis defining a proximal direction and a distal direction, the lock assembly comprising:

a shackle comprising:

a proximal leg comprising a proximal foot extending in a direction of a lateral axis of the lock assembly, the proximal foot including a proximal foot groove; and a distal leg connected to the proximal leg, the distal leg comprising a distal foot, wherein the distal foot includes an angled portion extending away from the proximal foot in the distal direction, and wherein the distal foot further includes a narrowed section including at least one distal foot groove extending parallel to the longitudinal axis, the at least one distal foot groove extending into the angled portion of the distal foot; and a crossbar extending along the longitudinal axis, wherein the proximal foot and the distal foot are received in the crossbar, the crossbar comprising:

a deadbolt having a first locking position in which the deadbolt extends into the proximal foot groove; and a first unlocking position in which the deadbolt does not extend into the proximal foot groove, wherein the deadbolt has a first lateral thickness, and wherein the deadbolt defines a longitudinally-extending channel;

a locking plate including a plate opening, the plate opening including an elongated portion and a locking slot extending from the elongated portion, the elongated portion extending to a longitudinal length that is larger than a maximum transverse width of the elongated portion such that the elongated portion has a generally non-circular configuration, the locking plate having a second locking position in which the narrowed section is received in the locking slot, and a second unlocking position in which the narrowed section is received in the elongated portion, wherein the locking plate has a second lateral thickness less than the first lateral thickness, wherein the locking plate further comprises a longitudinally-extending arm received in the longitudinally-extending channel, and wherein the arm is coupled to the deadbolt via a pin; and a lock cylinder including a cam, wherein the lock cylinder is operable to rotate the cam between a first cam position defining a locking state and a second cam position defining an unlocking state;

wherein, in the locking state, the deadbolt is in the first locking position and prevents removal of the proximal foot from the crossbar, and the locking plate is in the second locking position and prevents removal of the distal foot from the crossbar;

wherein, in the unlocking state, the deadbolt is in the first unlocking position and does not prevent removal of the proximal foot from the crossbar, and the locking plate is in the second unlocking position and does not prevent removal of the distal foot from the crossbar;

wherein each of the first locking position and the second locking position is a proximal position;

wherein each of the first unlocking position and the second unlocking position is a distal position; and wherein the locking plate is coupled to the deadbolt for joint longitudinal movement therewith.

2. The locking assembly of claim 1, wherein each of the at least one distal foot grooves has a lateral width corresponding to a lateral thickness of the locking plate.

3. The locking assembly of claim 1, wherein the cam is received within a recess formed in the deadbolt.

4. The locking assembly of claim 1, wherein the at least one distal foot groove comprises two distal foot grooves, and wherein the two distal foot grooves are positioned on opposite sides of the distal foot and are not in communication with each other.

5. The locking assembly of claim 4; wherein the locking slot is defined by two longitudinally-extending edges spaced apart by a distance corresponding to a thickness of the narrowed section.

6. A lock assembly having a longitudinal axis defining a proximal direction and a distal direction, the lock assembly comprising:

a shackle comprising:

a proximal leg comprising a proximal foot extending in a direction of a lateral axis of the lock assembly, the proximal foot including a proximal foot groove; and a distal leg connected to the proximal leg, the distal leg comprising a distal foot, wherein the distal foot includes an angled portion extending away from the proximal foot in the distal direction, and wherein the distal foot further includes a narrowed section including at least one distal foot groove extending parallel to the longitudinal axis, the at least one distal foot groove extending into the angled portion of the distal foot; and a crossbar extending along the longitudinal axis, wherein the proximal foot and the distal foot are received in the crossbar, the crossbar comprising:

a lock cylinder including a cam, wherein the lock cylinder is operable to rotate the cam between a first cam position and a second cam position;

a locking mechanism having a proximal locking position and a distal unlocking position, the locking mechanism comprising:

a longitudinally movable deadbolt, wherein the deadbolt has a first lateral thickness and defines a longitudinal channel; and a longitudinally movable locking plate, wherein the locking plate has a second lateral thickness less than the first lateral thickness, wherein the locking plate includes an arm extending into the longitudinal channel, wherein the locking plate is coupled to the deadbolt for joint longitudinal movement therewith by a pin that passes through the arm and an adjacent portion of the deadbolt, wherein the locking plate includes a plate opening, and wherein the plate opening includes an enlarged portion and a locking slot extending from the enlarged portion in the distal direction;

wherein the locking mechanism is engaged with the cam and is configured to move between the proximal locking position and the distal unlocking position in response to rotation of the cam between the first cam position and the second cam position;

wherein, with the locking mechanism in the proximal locking position, the deadbolt extends into the proximal foot groove, the narrowed section of the distal foot is received in the locking slot, and the locking mechanism prevents removal of the proximal foot and the distal foot from the crossbar; and wherein, with the locking mechanism in the distal unlocking position, the deadbolt does not extend into the proximal foot groove, the narrowed section of the distal foot is received in the enlarged portion of the plate opening, and the locking mechanism permits removal of the proximal foot and the distal foot from the crossbar.

7. The locking assembly of claim 6, wherein the at least one distal foot groove comprises two distal foot grooves, and wherein the two distal foot grooves are positioned on opposite sides of the distal foot and are not communication with each other.

8. The locking assembly of claim 7, wherein the locking slot is defined by two longitudinally-extending edges spaced apart by a distance corresponding to a thickness of the narrowed section.

9. A lock assembly having a longitudinal axis defining a proximal direction and a distal direction, the lock assembly comprising:

a shackle comprising:

a proximal leg comprising a proximal foot extending in a direction of a lateral axis of the lock assembly, the proximal foot including a proximal foot groove; and a distal leg connected to the proximal leg, the distal leg comprising a distal foot, wherein the distal foot includes an angled portion extending away from the proximal foot in the distal direction, and wherein the distal foot further includes a narrowed section including a first distal foot groove and a second distal foot groove, the first and second distal foot grooves extending longitudinally along opposing sides of the distal foot and not being in communication with each other, the first and second distal foot grooves extending into the angled portion of the distal foot; and a crossbar comprising:

a tubular housing extending along the longitudinal axis, wherein the proximal foot and the distal foot are received within the housing, wherein pivoting of the shackle in a decoupling direction causes the proximal foot to exit the housing, and wherein the decoupling direction is defined about a transverse axis of the lock assembly;

a locking mechanism slidably mounted in the housing for longitudinal movement between a proximal locking position and a distal unlocking position, the locking mechanism comprising a deadbolt including a channel and a locking plate including an arm received in the channel, wherein the deadbolt has a first lateral thickness, wherein the locking plate has a second lateral thickness less than the first lateral thickness, wherein the deadbolt and the locking plate are coupled for joint longitudinal movement in the distal direction and the proximal direction by a pin that engages the arm and an adjacent portion of the deadbolt, and wherein the locking plate includes a plate opening having an elongated portion and a locking slot extending from the elongated portion in the distal direction, the elongated portion having a maximum longitudinal length that is larger than a maximum transverse length of the elongated portion; and a lock cylinder including a cam engaged with the locking mechanism; wherein the lock cylinder is operable to rotate the cam in a first rotational direction and an opposite second rotational direction, wherein the cam is configured to drive the locking mechanism toward the proximal locking position when rotated in the first rotational direction, and wherein the cam is configured to drive the locking mechanism toward the distal unlocking position when rotated in the second rotational direction;

wherein with the locking mechanism in the proximal locking position, the deadbolt is engaged with the proximal foot groove, the narrowed section of the distal foot is received in the locking slot such that the locking plate is engaged with the first and second distal foot grooves, and the locking mechanism prevents pivoting of the shackle in the decoupling direction; and wherein with the locking mechanism in the distal unlocking position, the deadbolt is disengaged from the proximal foot groove, the narrowed section of the distal foot is received in the elongated portion of the plate opening, and the shackle is capable of pivoting in the decoupling direction.

10. The lock assembly of claim 9, wherein the longitudinal axis, the lateral axis, and the transverse axis are mutually orthogonal.

11. The lock assembly of claim 9, wherein the first and second distal foot grooves extend parallel to the longitudinal axis.

12. The lock assembly of claim 11, wherein the first and second distal foot grooves extend from a generally proximate side of the distal foot to positions along the angled portion that are longitudinally offset away from a generally distal facing outer surface of the angled portion.

13. The lock assembly of claim 9, wherein the cam is received within a recess formed in the deadbolt.

14. The lock assembly of claim 9, wherein the proximal foot groove has a first lateral width, and wherein the first and second distal foot grooves each have a second lateral width less than the first lateral width.

* * * * *